US008333619B2

(12) United States Patent
Kondo et al.

(10) Patent No.: US 8,333,619 B2
(45) Date of Patent: Dec. 18, 2012

(54) CONNECTOR

(75) Inventors: Hayato Kondo, Yao (JP); Toshiharu Miyoshi, Yao (JP)

(73) Assignee: Hosiden Corporation, Yao-shi (JP)

( * ) Notice: Subject to any disclaimer, the term of this patent is extended or adjusted under 35 U.S.C. 154(b) by 431 days.

(21) Appl. No.: 12/621,851

(22) Filed: Nov. 19, 2009

(65) Prior Publication Data

US 2010/0203768 A1 Aug. 12, 2010

(30) Foreign Application Priority Data

Feb. 9, 2009 (JP) ..... 2009-027320

(51) Int. Cl.
*H01R 24/00* (2006.01)

(52) U.S. Cl. ..... 439/676

(58) Field of Classification Search ..... 439/676, 439/620.13, 620.17, 607.23, 188; 29/884
See application file for complete search history.

(56) References Cited

U.S. PATENT DOCUMENTS

| | | | | |
|---|---|---|---|---|
| 5,647,770 | A * | 7/1997 | Belopolsky | 439/676 |
| 5,687,478 | A * | 11/1997 | Belopolsky | 29/884 |
| 6,113,418 | A * | 9/2000 | Kjeldahl | 439/405 |
| 6,164,995 | A * | 12/2000 | Peloza | 439/188 |
| 6,368,155 | B1 * | 4/2002 | Bassler et al. | 439/620.21 |
| 6,454,605 | B1 * | 9/2002 | Bassler et al. | 439/607.23 |
| 6,540,559 | B1 * | 4/2003 | Kemmick et al. | 439/607.05 |
| 6,575,789 | B2 * | 6/2003 | Bassler et al. | 439/607.23 |
| 6,896,557 | B2 * | 5/2005 | Aekins et al. | 439/676 |
| 7,037,140 | B2 * | 5/2006 | Aekins et al. | 439/676 |
| 7,165,981 | B2 * | 1/2007 | Bassler et al. | 439/101 |
| 7,485,010 | B2 * | 2/2009 | Aekins | 439/676 |
| 7,575,454 | B1 * | 8/2009 | Aoki et al. | 439/188 |
| 7,806,704 | B2 * | 10/2010 | Miyoshi et al. | 439/108 |
| 2008/0311797 | A1 * | 12/2008 | Aekins | 439/676 |
| 2009/0017646 | A1 | 1/2009 | Nagata | 439/65 |

FOREIGN PATENT DOCUMENTS

| | | | |
|---|---|---|---|
| EP | 1 531 527 | A2 | 5/2005 |
| EP | 2 148 399 | A1 | 1/2010 |
| JP | 2003-505826 | A1 | 2/2003 |
| WO | WO 01/06602 | A1 | 1/2001 |
| WO | WO 01/76015 | A1 | 10/2001 |

OTHER PUBLICATIONS

Copending U.S. Appl. No. 12/482,627, filed Jun. 11, 2009, inventors Toshiharu Miyoshi, et al.
European Search Report dated Jun. 17, 2011 for counterpart European patent application No. 10250210.1.

* cited by examiner

*Primary Examiner* — Alexander Gilman
(74) *Attorney, Agent, or Firm* — Kratz, Quintos & Hanson, LLP

(57) ABSTRACT

A connector according to the invention includes an insulative body, and a first contact and a second contact that are disposed in the body at different height levels from each other, the first contact or the second contact being elastically deformable. The first contact includes an mismatched portion having an higher impedance than that of another portion of the first contact. The second contact includes an adjusting portion to be brought close to the mismatched portion by elastic deformation of the first contact or the second contact in a direction close to the second contact or the first contact.

33 Claims, 15 Drawing Sheets

CONNECTOR

The present application claims priority under 35 U.S.C. §119 of Japanese Patent Application No. 2009-027320 filed on Feb. 9, 2009, the disclosure of which is expressly incorporated by reference herein in its entity.

BACKGROUND OF THE INVENTION

1. Technical Field

The present invention relates to connectors that are used mainly for high-speed digital signal transmission and are capable of providing favorable impedance matching.

2. Background Art

A known connector of this kind has pairs of differential contacts compliant with a new standard and contacts compliant with a conventional standard. In the pairs of differential contacts compliant with the new standard, the pitch distance between portions of the contacts in the vicinity of the contact portions, as well as the widths thereof, are different from those of other portions of the contacts. These differences cause differences in impedance between the portions in the vicinity of the contact portions and the other portions.

A solution to this problem is to provide ground contacts near the portions in the vicinity of the contact portions so as to adjust the impedances between the portions in the vicinity of the contact portions of the differential pair contacts and the other portions, as disclosed in Japanese Unexamined Patent Application Publication No. 2003-505826

SUMMARY OF INVENTION

Technical Problem

However, the provision of ground contacts near the portions in the vicinity of the contact portions of the differential pair contacts leads to increase in number of components and in complexity of the entire configuration of the connector.

The present invention has been made in view of the above circumstances. It is an object of the invention to provide a novel connector compliant with two standards and in a simple configuration with matched impedances in a contact.

Solution to Problem

In order to solve the above problems, a connector according to the present invention includes an insulative body; and a first contact and a second contact that are disposed in the body at different height levels from each other, the first contact or the second contact being elastically deformable. The first contact includes an mismatched portion having an higher impedance than that of another portion of the first contact. The second contact includes an adjusting portion to be brought close to the mismatched portion by elastic deformation of the first contact or the second contact in a direction close to the second contact or the first contact.

In the connector thus configured, when the first contact compliant with a first standard or the second contact compliant with a second standard is elastically deformed in the direction of close to the second contact or the first contact, the adjusting portion of the second contact is brought close to the mismatched portion of the first contact. As a result, the mismatched portion increases in capacitance and decreases in impedance. It is therefore possible to alleviate the impedance mismatch between the mismatched portion and the another portion of the first contact without providing a ground contact as in the conventional art. Such connector has an advantageously simple configuration and can be manufactured at low cost.

If the connector has a pair of first contacts for differential signaling, the second contact may be disposed between the first contacts in plane position.

In a state where the first contacts or the second contact is elastically deformed, a distance between each of the mismatched portions and the adjusting portion may be smaller than a distance between each of the another portions of the first contacts and another portion of the second contact. In this case, the adjusting portion is brought to a smaller distance from each of the mismatched portions relative to the distance between each of the another portions of the first contacts and the another portion of the second contact, so that the mismatched portions can further improve in impedance, resulting in matched impedances between the mismatched portions and the another portions of the first contacts.

If a pitch distance between the mismatched portions of the paired first contacts is larger than a pitch distance between the another portions of the paired first contacts, in the state where the first contacts or the second contact is elastically deformed in the direction close to the second contact or the first contacts, the adjusting portion may be inserted between the mismatched portions of the paired first contacts so as to be located at an equal distance from either of the mismatched portions. The body may be provided with a retaining portion for allowing leading end portions of the first contacts or a leading end portion of the second contact to be in contact therewith in a preloaded state so as to prevent the first contacts or the second contact from elastically deforming in a direction away from the second contact or the first contacts.

Even in the above case where the mismatched portions of the paired first contacts have significantly higher impedances than the another portions due to the larger pitch distance therebetween than that between the another portions, impedances can be matched between the mismatched portions and the another portions of the paired first contacts by inserting the adjusting portion between the mismatched portions so that the adjusting portion is disposed at the equal distance from either of the mismatched portions. Moreover, since the pitch distance between the mismatched portions is larger than that between the another portions in the first contacts, the adjusting portion can be kept from interfering with the mismatched portions when inserted therebetween.

The body may be provided with a guide hole for receiving the leading end portion of one of the first and second contacts so as to be movable in a direction along elastic deformation of the one of the first and second contacts. In this case, as the guide hole guides the leading end portion of one of the first and second contacts, the one of the first and second contacts can elastically deforms accurately in the direction close to the other contact.

The adjusting portion may be the leading end portion of the second contact.

The second contact may be disposed offset toward one of the paired first contacts. The second contact may have a first overlapping portion overlapping one of the first contacts in plane position and a second overlapping portion overlapping the other first contact in plane position. Areas of the first and second overlapping portions overlapping the first contacts may be adjusted in accordance with a difference in impedance between the first contacts.

In this case, the first contacts have matched impedances because the areas of the first and second overlapping portions of the second contact overlapping the paired first contacts are adjusted in accordance with the difference in impedance between the first contacts. In other words, the second contact of the second standard can be utilized not only to match impedances between the mismatched portion and the another portion of each of the first contacts but also to match impedances between the first contacts. Such connector has an advantageously simple configuration and can be manufactured at low cost.

The areas of the first and second overlapping portions overlapping the first contacts may be substantially equal to each other. In this case, the capacitances of the first contacts are made substantially equal to each other because of substantially equalized areas of the first and second overlapping portions overlapping the first contacts, thereby achieving matched impedance between the first contacts.

If the first and second overlapping portions are located at widthwise opposite ends of the second contact, at least one of the first and second overlapping portions can be extended in the width direction. In this case, the areas of the first and second overlapping portions overlapping the first contacts can be made substantially equal to each other by extension in the width direction of the at least one of the first and second overlapping portions. In short, impedances can be easily matched between the first contacts by simply changing the width of the second contact.

If the second contact is an elastically deformable terminal, the second contact may be provided with a resilience suppressor for suppressing increase in resilience of the second contact due to extension in the width direction of the at least one of the first and second overlapping portions. Providing the resilience suppressor can suppress increase in resilience of the second contact caused by extension in the width direction of at least one of the first and second overlapping portions. The resilience suppressor can thus suppress increase in contact pressure of the second contact due to increase in resilience of the second contact.

The resilience suppressor may be an opening made in an intermediate portion between the first and second overlapping portions of the second contact. Providing the opening in the intermediate portion between the first and second overlapping portions of the second contact can favorably suppress increase in resilience of the second contact due to extension in the width direction of at least one of the first and second overlapping portions, and can accordingly suppress increase in contact pressure of the second contact. The second contact can thus be brought into contact with a target contact at a predetermined contact pressure. Another advantage is ease of impedance matching between the first contacts. More particularly, the areas of the first and second overlapping portions overlapping the first contacts can be adjusted by changing the shape and/or size of the opening. Still another advantage of providing the opening in the intermediate portion of the second contact is reduction of the areas of the first and second overlapping portions of the second contact overlapping the first contacts, resulting in reduction in impedance of the first contacts.

Alternatively, the second contact may further be provided with a connecting portion for connecting the first overlapping portion on a leading side and the second overlapping portion on a proximal side, and the connecting portion extends perpendicularly or at an angle to the first and second overlapping portions. In this case, impedances can be easily matched between the first contacts by simply providing the connecting portion to connect between the first overlapping portion on the leading side and the second overlapping portion on the proximal side, which have substantially equal areas overlapping the respective first contacts.

Another connector according to the present invention includes an insulative body; and a first contact and a second contact that are disposed in the body at different height levels from each other, the first contact or the second contact being elastically deformable. The first contact includes a mismatched portion having a lower impedance than that of another portion of the first contact. The second contact includes an adjusting portion to be brought apart from the mismatched portion by elastic deformation of the first contact or the second contact in a direction of away from the second contact or the first contact.

In the connector thus configured, when the first contact compliant with the first standard or the second contact compliant with the second standard is elastically deformed in the direction away from the second contact or the first contact, the adjusting portion of the second contact is brought away from the mismatched portion of the first contact. As a result, the mismatched portion decreases in capacitance and increases in impedance. It is therefore possible to alleviate the impedance mismatch between the mismatched portion and the another portion of the first contact without providing a ground contact as in the conventional art. Such connector has an advantageously simple configuration and can be manufactured at low cost.

BRIEF DESCRIPTION OF DRAWINGS

FIGS. 4A and 4B are diagrammatic cross-sectional views taken a portion of the connector along line 4-4 in FIG. 2, in which FIG. 4A shows a rear end portion of a main portion of a Vbus contact before elastic deformation, and FIG. 4B shows the rear end portion of the main portion of the Vbus contact after elastic deformation.

FIGS. 5A and 5B are diagrammatic cross-sectional views taken a portion of the connector along line 5-5 in FIG. 2, in which FIG. 5A shows a leading end portion of the main portion of the Vbus contact before elastic deformation, and FIG. 5B shows the leading end portion of the main portion of the Vbus contact after elastic deformation.

FIGS. 13A and 13B are schematic views of a design variation of the TX+ signaling contact, the TX− signaling contact, and the Vbus contact of the connector, in which FIG. 13A is a bottom view and FIG. 13B is a cross-sectional view.

FIGS. 14A and 14B are schematic views of another design variation of the TX+ signaling contact, the TX− signaling contact, and the Vbus contact of the connector, in which FIG. 14A is a bottom view and FIG. 14B is a cross-sectional view.

FIGS. 15A to 15C are schematic bottom views of design variations of the Vbus contact of the connector, in which FIG. 15A shows a configuration with no opening provided therein, FIG. 15B shows a configuration with a bent intermediate portion of an elastic deformation portion, and FIG. 15C shows a configuration with semicircular overlapping portions provided at ends of the elastic deformation portion.

DESCRIPTION OF EMBODIMENTS

A connector according to an embodiment of the present invention is described below with reference to FIGS. 1 to 12.

Exemplified herein is a receptacle connector that is mountable on a circuit board 10 and is connectable with a plug connector compliant with USB 3.0 or USB 2.0 (not shown).

Figure 1:
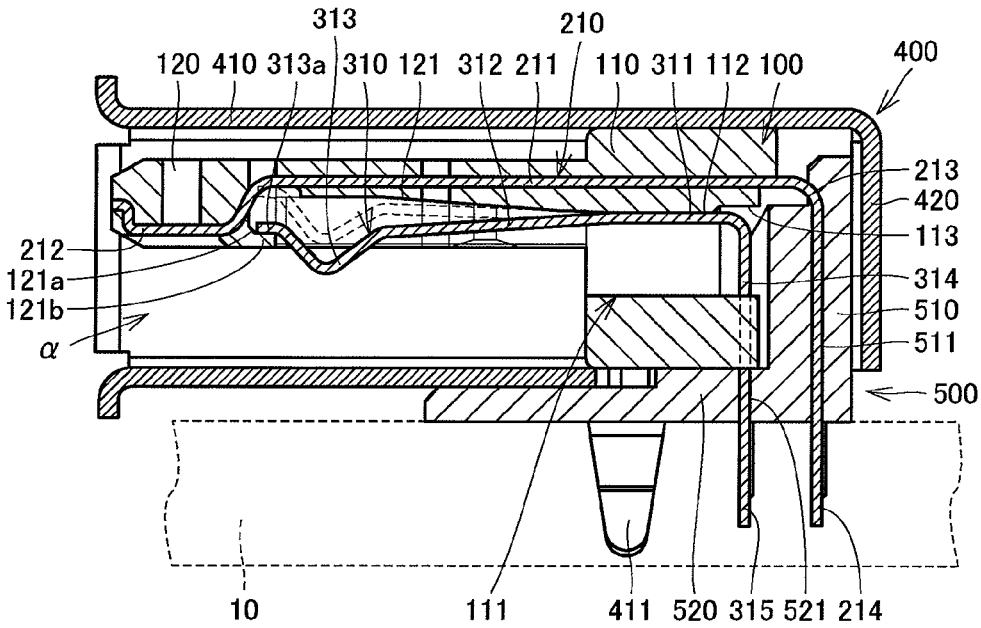
FIG. 1 is a schematic cross-sectional view of a connector according to an embodiment of the present invention.
Figure 2:
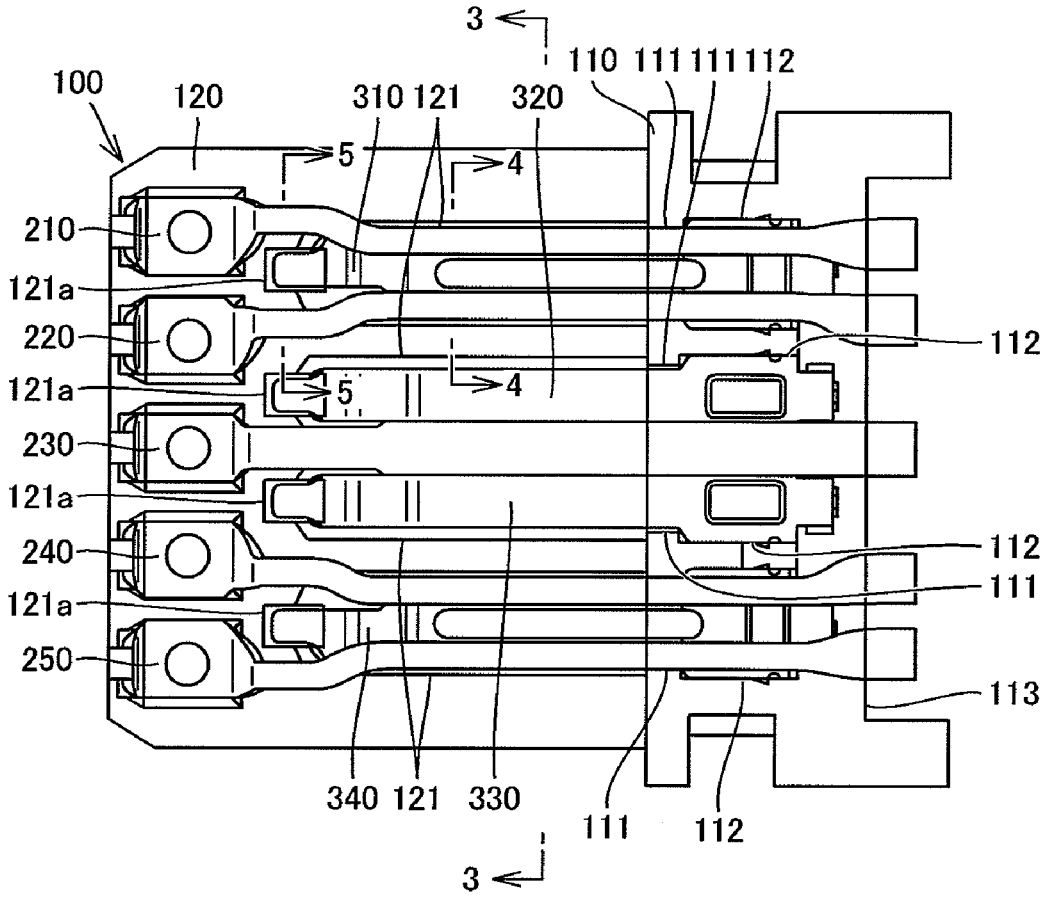
FIG. 2 is a schematic plan view of the connector with a shell removed, illustrating the inside of the connector transparently.
Figure 3:
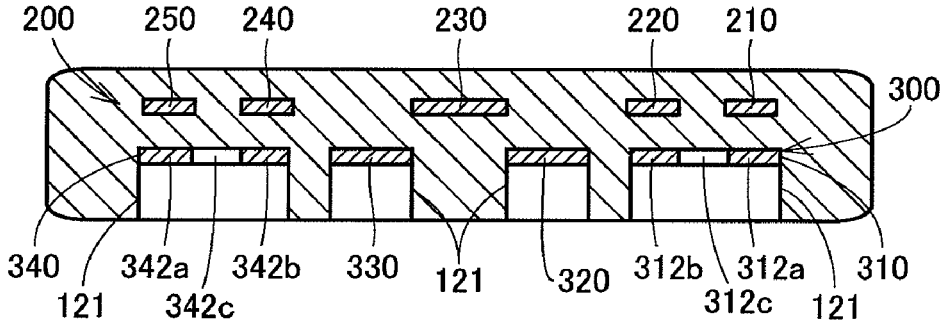
FIG. 3 is a diagrammatic cross-sectional view taken along line 3-3 in FIG. 2.

As shown in FIGS. 1 to 3, the receptacle connector includes a body 100, a USB 3.0 contact group 200, a USB 2.0 contact group 300, a shell 400 for covering the body 100, and a spacer 500 to be attached to the body 100. Each of these elements will be described in detail below.

The body 100 is a molded article produced by injection molding a general-purpose insulative synthetic resin such as a PBT (polybutylene terephthalate) or a PPS (polyphenylene sulfide). As shown in FIGS. 1 to FIG. 7, the body 100 includes a generally cuboid body main portion 110, and a plate-like protrusion 120 that projects from a front upper portion of the body main portion 110.

As shown in FIGS. 1 to 3, embedded in the upper portions of the body main portion 110 and the protrusion 120 are a TX+ signaling contact 210, a TX− signaling contact 220, a ground contact 230, an RX+ signaling contact 240, and an RX− signaling contact 250 (to be described later) of the USB 3.0 contact group 200 so as to be spaced apart from one another in the width direction of the body 100. The TX+ signaling contact 210, the TX− signaling contact 220, the ground contact 230, the RX+ signaling contact 240, and the RX− signaling contact 250 are disposed corresponding to the positions of the USB 3.0 plug contacts of the USB 3.0 plug.

Figure 7:
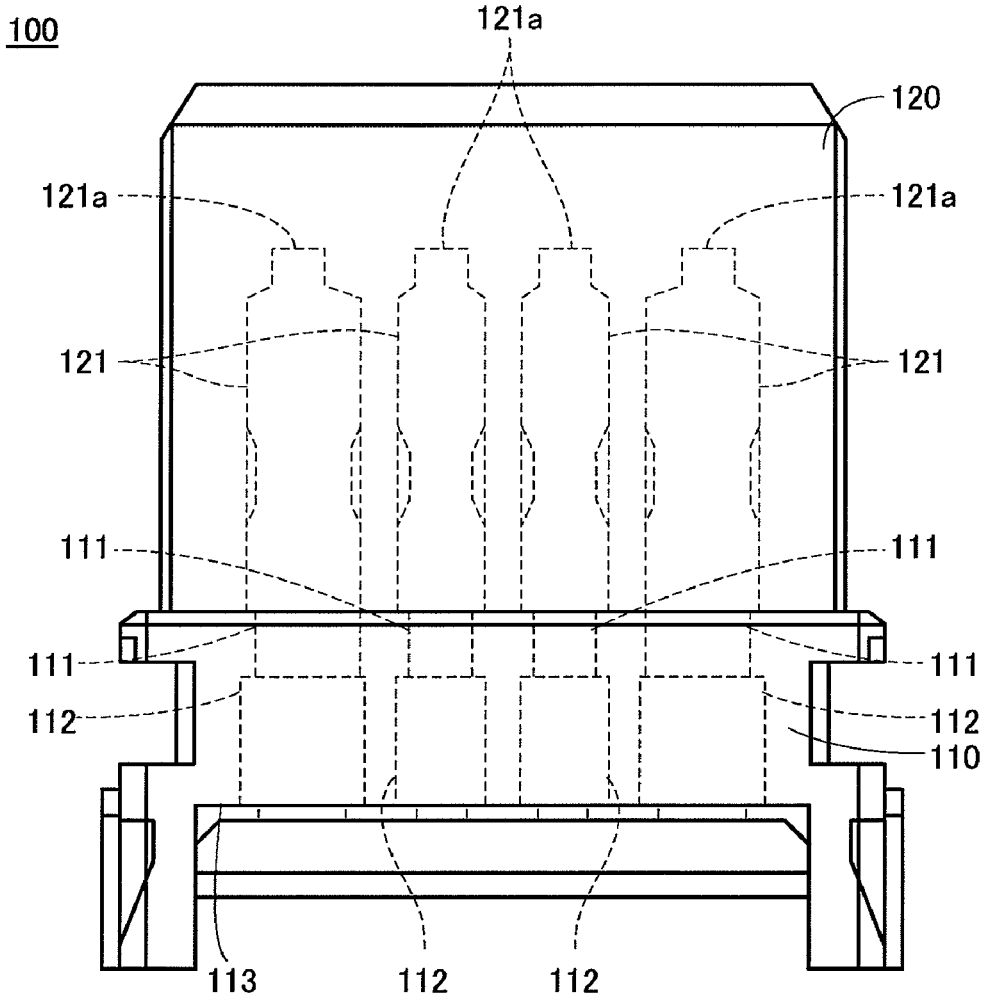
FIG. 7 is a schematic bottom view illustrating the inside of the body of the connector transparently.

The front central portion of the body main portion 110 has four front recesses 111 of generally rectangular shape as shown in FIGS. 1, 2, and 7, at corresponding positions to the positions of the USB 2.0 plug contacts of the USB 2.0 plug. Above the front recesses 111 of the body main portion 110, there are four press-fitting holes 112 that communicate with the respective front recesses 111.

The press-fitting holes 112 press-fittingly receive press fitting portions 311, 321, 331, and 341 of a Vbus contact 310, a Data− contact 320, a Data+ contact 330, and a GND contact 340 (to be described later) of the USB 2.0 contact group 300. The Vbus contact 310, the Data− contact 320, the Data+ contact 330, and the GND contact 340 received in the press-fitting holes 112 are led out at their elastic deformation portions 312, 322, 332, and 342 (to be described later) from the front recesses 111.

There are provided four recesses 121 of generally rectangular parallelepiped shape at the lower end of the protrusion 120. The longitudinal ends of the recesses 121 communicate with the respective front recesses 111. The recesses 121 respectively receive portions led out from the front recesses 111 of the Vbus contact 310, the Data− contact 320, the Data+ contact 330, and the GND contact 340 of the USB 2.0 contact group 300—more particularly, the elastic deformation portions 312, 322, 332, and 342 and movable contact portions 313, 323, 333, and 343 (to be described later).

As shown in FIG. 1, each of the recesses 121 is provided in its inner wall on the other longitudinal end with a guide hole 121*a* that extends vertically. The guide holes 121*a* receive and guide leading end portions 313*a*, 323*a*, 333*a*, and 343*a* of the movable contact portions 313, 323, 333, and 343 in a vertically movable manner. The lower edges of the guide holes 121*a* are in contact with the leading end portions 313*a*, 323*a*, 333*a*, and 343*a* so as to function as retaining portions 121*b* for retaining the Vbus contact 310, the Data− contact 320, the Data+ contact 330, and the GND contact 340 in a preload state.

As shown in FIGS. 1 and 2, the body main portion 110 is provided in its rear central portion with a rear recess 113 that communicates with the four press-fitting holes 112. In the Vbus contact 310, the Data− contact 320, the Data+ contact 330, and the GND contact 340 of the USB 2.0 contact group 300 that are partly press-fitted into the press-fitting holes 112, their lead-out portion 314, 324, 334, and 344 (to be described later) are led out of the body 100 through the rear recess 113. In the TX+ signaling contact 210, the TX− signaling contact 220, the ground contact 230, the RX+ signaling contact 240, and the RX− signaling contact 250 of the USB 3.0 contact group 200 that are embedded in the upper portions of the body main portion 110 and the protrusion 120, their lead-out portions 213, 223, 233, 243, and 253 (to be described later) are also led out of the body 100 through the rear recess 113. As shown in FIG. 1, the rear recess 113 fittingly receives a perpendicular portion 510 of the substantially plate-like spacer 500 of a generally L-shape in side view.

The shell 400 is a rectangular tubular member made of metal. As shown in FIG. 1, the shell 400 has a shell main portion 410 and a cover 420 that is continuous from the upper portion of the rear end of the shell main portion 410.

The shell main portion 410 covers the outer periphery of the body 100. There is accordingly formed a plug insertion space a between the protrusion 120 of the body 100 and the lower end of the shell main portion 410. The plug insertion space a is adapted to receive a USB 3.0 plug or a USB 2.0 plug. Opposite ends of the shell main portion 410 are provided with paired connecting pieces 411 (only one of which being shown in FIG. 1) to be connected to a ground line on the circuit board 10.

The cover 420 is bent substantially perpendicularly to the shell main portion 410 so as to cover the rear end surface of the spacer 500 that is attached to the body 100.

Figure 8:
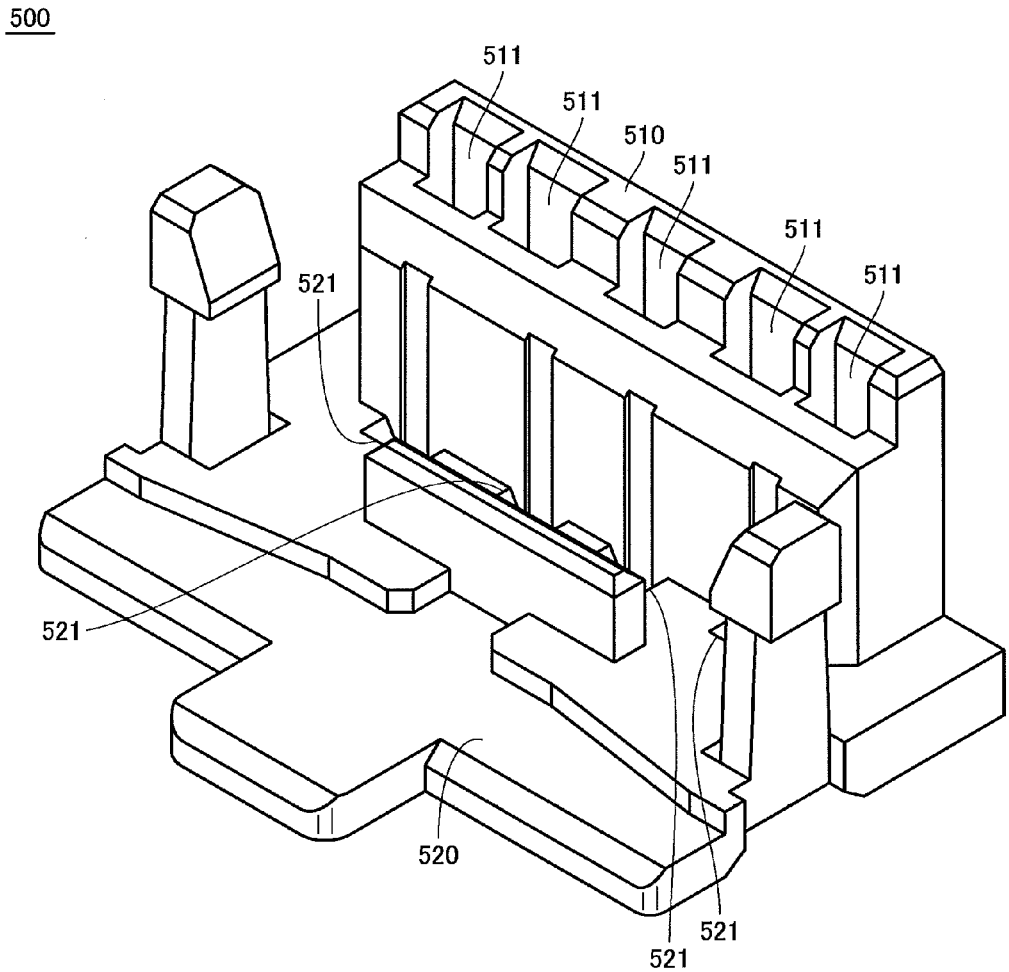
FIG. 8 is a schematic perspective view of a spacer of the connector.

As shown in FIGS. 1 and 8, the spacer 500 is a molded article in a generally L shape in cross-section, produced by injection molding a general-purpose insulative synthetic resin similar to that of the body 100. This spacer 500 has the perpendicular portion 510 and a base portion 520 disposed perpendicularly to the perpendicular portion 510.

The perpendicular portion 510 has five through holes 511 for passing therethrough the lead-out portions 213, 223, 233, 243, and 253 of the TX+ signaling contact 210, the TX− signaling contact 220, the ground contact 230, the RX+ signaling contact 240, and the RX− signaling contact 250 of the USB 3.0 contact group 200. The base portion 520 is a plate-like member to be placed on the circuit board 10. The base portion 520 has four through holes 521 for passing therethrough connecting portions 315, 325, 335, and 345 (to be described later) of the Vbus contact 310, the Data− contact 320, the Data+ contact 330, and the GND contact 340 in the USB 2.0 contact group 300. The base portion 520 is also provided with paired locking arms to be locked at the two ends of the body 100.

Figure 9:
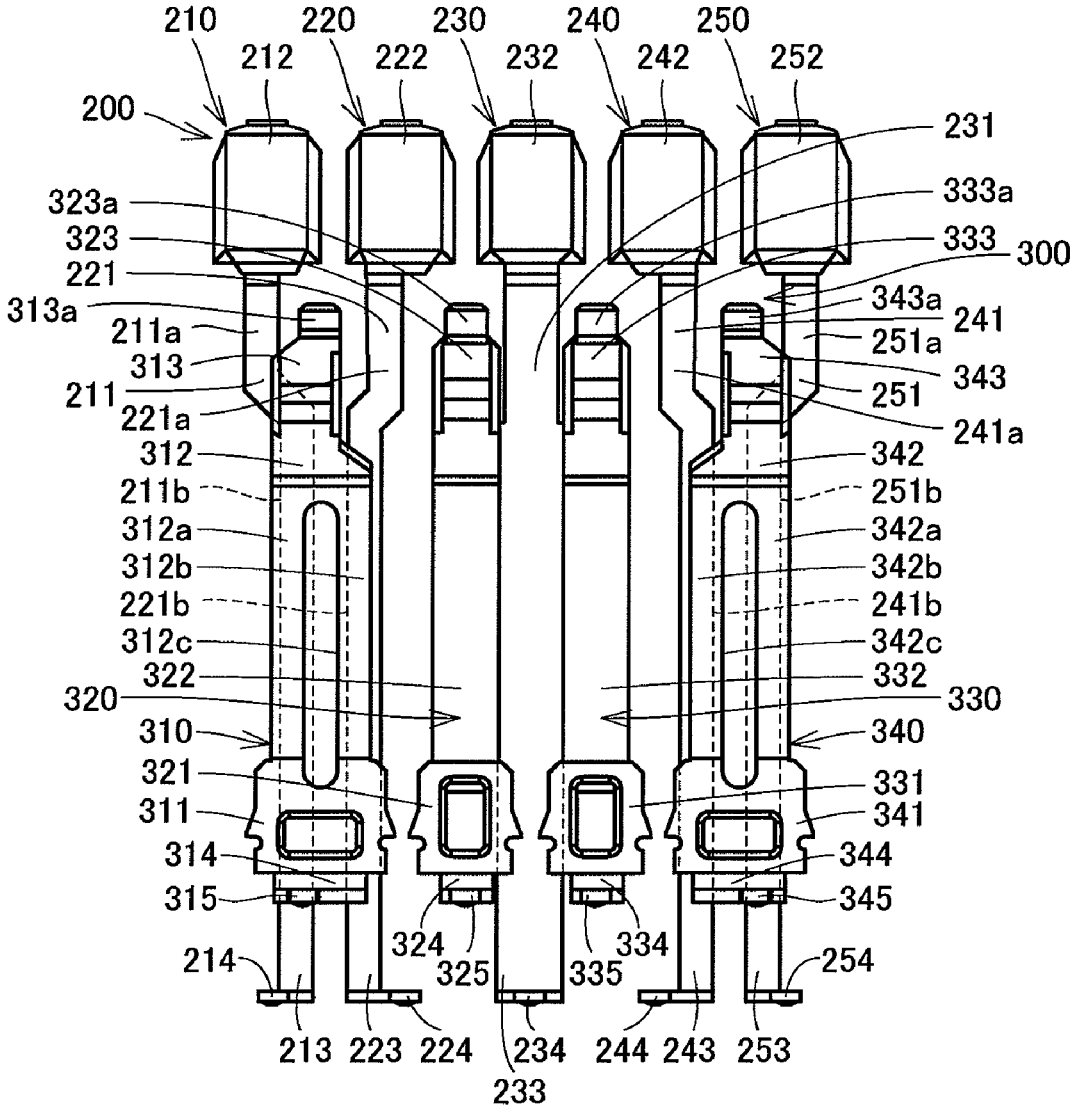
FIG. 9 is a schematic bottom view showing the layout of the contacts of the connector.

As shown in FIGS. 2, 3 and 9, the USB 3.0 contact group 200 includes the TX+ signaling contact 210 (one of a pair of first contacts for differential signaling), the TX− signaling contact 220 (the other of the pair of first contacts), the ground contact 230, the RX+ signaling contact 240 (one of a pair first contacts for differential signaling), and the RX− signaling contact 250 (the other of the pair of first contacts).

Figure 10:
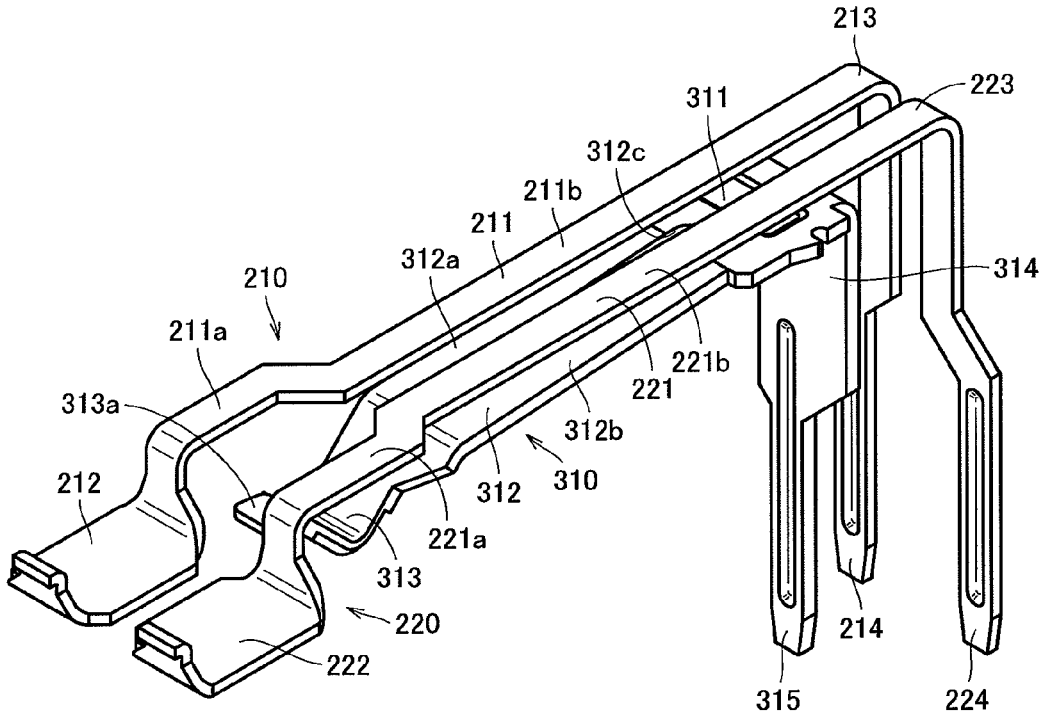
FIG. 10 is a schematic perspective view of a TX+ signaling contact, a TX− signaling contact, and the Vbus contact of the connector.
Figure 11A:
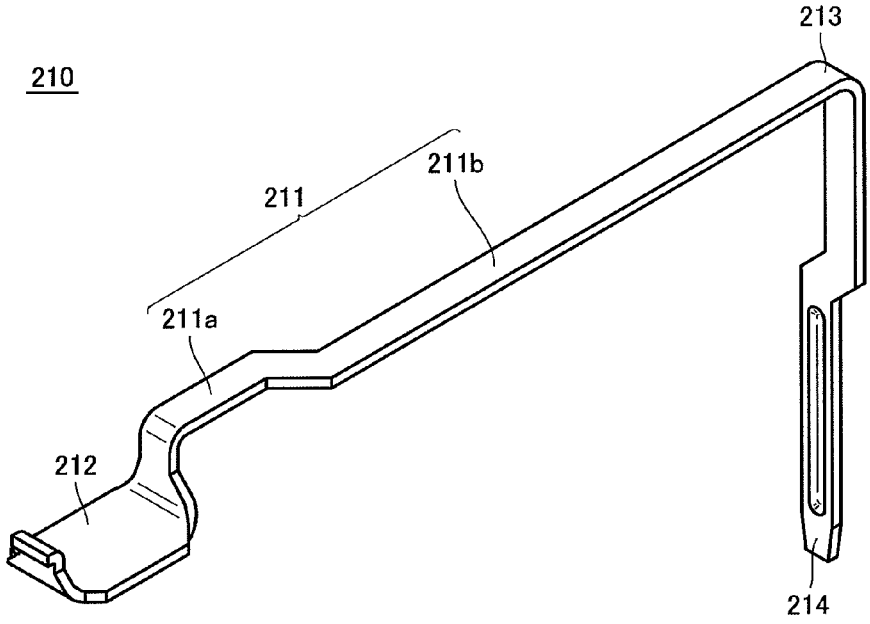
FIG. 11A is a schematic perspective view of the TX+ signaling contact of the connector.

The TX+ signaling contact 210 is a conductive terminal of a substantially L shape in cross section, as shown in FIGS. 9, 10, and 11A. The TX+ signaling contact 210 has a plate-like main portion 211, a contact portion 212 continuous from the leading end of the main portion 211, the substantially L-shaped lead-out portion 213 continuous from the rear end of the main portion 211, and a plate-like connecting portion 214 continuous from the rear end of the lead-out portion 213.

As shown in FIG. 1, the main portion 211 is embedded by insert molding above the front recess 111 and the recess 121 of the body 100. The main portion 211 has a leading end portion 211*a* bent widthwise and a rear end portion 211*b*.

The contact portion 212 is a plate-like member that is bent in a substantially U shape in cross section and is wider than the main portion 211. The contact portion 212 is embedded by insert molding in the leading end of the protrusion 120. The contact portion 212 has a lower face exposed from a cutout that is provided at the lower edge of the leading end of the protrusion 120 so as to be contactable with a USB 3.0 plug contact.

The lead-out portion 213 of a generally L shape in cross section is led out from the rear recess 113. The perpendicular portion of the lead-out portion 213 is adapted to pass through an associated through hole 511 in the perpendicular portion 510 of the spacer 500.

The connecting portion 214 projects downward from the spacer 500. It is electrically connectable with a signal line on the circuit board 10 by soldering or other means.

Figure 11B:
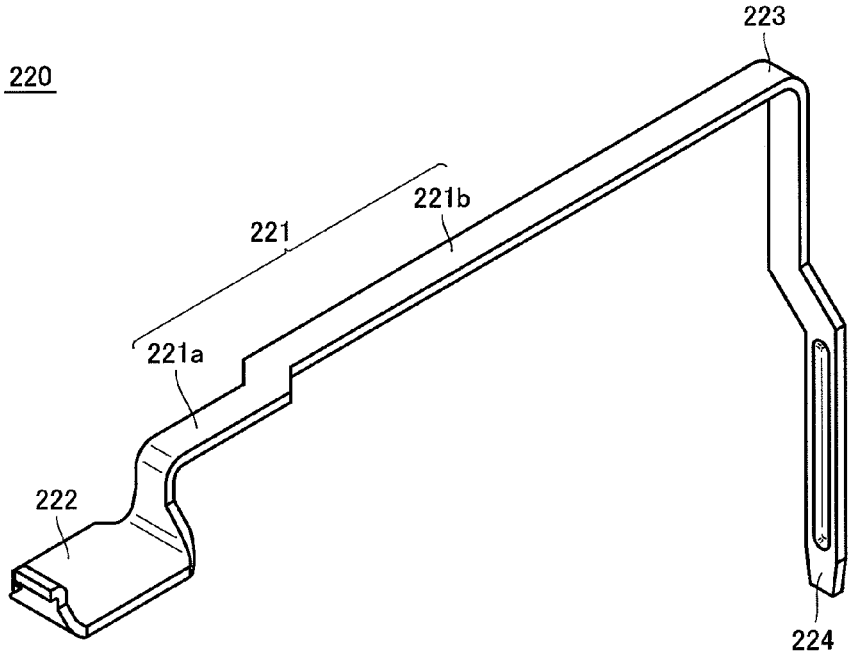
FIG. 11B is a schematic perspective view of the TX− signaling contact thereof.

As shown in FIGS. 9, 10, and 11B, the TX− signaling contact 220 has a substantially same configuration with that of the TX+ signaling contact 210, except that a leading end portion 221*a* of a main portion 221 is bent oppositely with respect to the leading end portion 211*a* of the main portion 211 of the contact 210. Therefore, the portions other than the leading end portion 221*a* will not be repeatedly described in detail.

Since the leading end portion 211*a* of the main portion 211 of the contact 210 and the leading end portion 221*a* of the main portion 221 of the contact 220 are bent in opposite directions, the pitch distance between the leading end portion 221*a* and the leading end portion 211*a* is larger than the pitch distance between the rear end portion 221*b* of the contact 220 and the rear end portion 211*b*. Accordingly, the leading end portion 211*a* of the main portion 211 has a higher impedance than the rear end portion 211*b*, resulting in an impedance mismatch between the leading end portion 211*a* and the rear end portion 211*b*. Similarly, the leading end portion 221*a* of the main portion 221 has a higher impedance than the rear end portion 221*b*, resulting in an impedance mismatch between the leading end portion 221*a* and the rear end portion 221*b*. Consequently, there exists an impedance mismatch between the TX+ signaling contact 210 and the TX− signaling contact 220. In the claims recited later herein, we refer to each of the leading end portion 211*a* and the leading end portion 221*a* as a "mismatched portion," and refer to each of the rear end portion 211*b* and the rear end portion 221*b* as "another portion."

The RX+ signaling contact 240 is a mirror image version of the TX− signaling contact 220. The RX− signaling contact 250 is a mirror image version of the TX+ signaling contact 210. Accordingly, the RX+ signaling contact 240 or the RX− signaling contact 250 will not be repeatedly described in detail.

As shown in FIG. 9, the ground contact 230 has a similar configuration to the TX+ signaling contact 210 etc., except that its main portion 231 is not bent but a straight plate-like member. There will accordingly be no detailed description of the ground contact 230.

The USB 2.0 contact group 300 as shown in FIGS. 2, 3, and 9 includes the Vbus contact 310 (second contact), the Data− contact 320, the Data+ contact 330, and the GND contact 340 (second contact).

Figure 12:
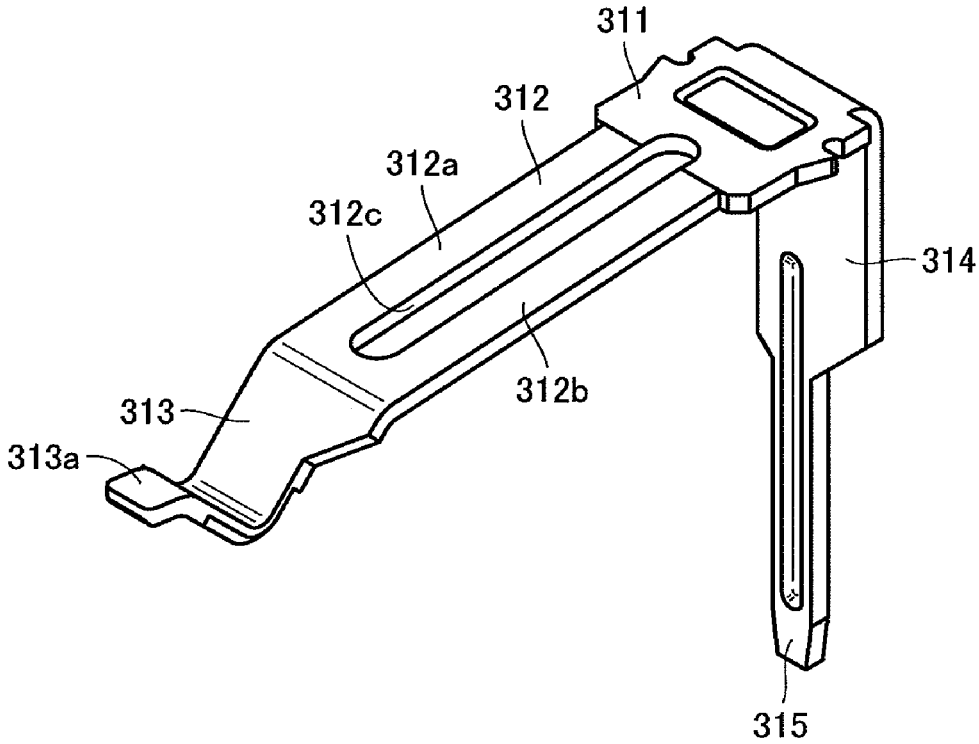
FIG. 12 is a schematic perspective view of the Vbus contact of the connector.

As shown in FIGS. 9 and 10, the Vbus contact 310 is a conductive terminal of a generally L shape in cross section and is smaller than the TX+ signaling contact 210 and the like. As shown in FIGS. 9, 10, and 12, the Vbus contact 310 has the press fitting portion 311, the elastic deformation portion 312 continuous from the leading end of the press fitting portion 311, the movable contact portion 313 continuous from the leading end of the elastic deformation portion 312, the lead-out portion 314 continuous from the rear end of the press fitting portion 311, and the connecting portion 315 continuous from the rear end of the lead-out portion 314.

The press fitting portion 311 has paired projections at the widthwise opposite ends. The press fitting portion 311 inclusive of these projections is slightly larger in width than the press fitting hole 112 in the body 100. The press fitting portion 311 is accordingly inserted into the press fitting hole 112 in the body 100 and is retained by the body 100. When the press fitting portion 311 is thus retained by the body 100, to be compliant with the USB 2.0 standard, the Vbus contact 310 is disposed below and between the TX+ signaling contact 210 and the TX− signaling contact 220, but located offset toward the TX+ signaling contact 210, as shown in FIGS. 2 and 9. This arrangement of the contacts causes a difference in impedance between the TX+ signaling contact 210 and the TX− signaling contact 220.

As shown in FIGS. 1, 9, 10, and 12, the movable contact portion 313 is a plate-like member in a generally V shape in cross section and with a smaller width than that of the elastic deformation portion 312. The leading end portion 313*a* of the movable contact portion 313 extends in a tongue shape.

As shown in FIG. 1, the elastic deformation portion 312 is a generally rectangular plate-like member that is inclined downward and is elastically deformable in the vertical direction.

With the press fitting portion 311 retained in the body 100, the elastic deformation portion 312 is received in the front recess 111 and the recess 121 of the body 100 and the movable contact portion 313 is received in the recess 121 of the body 100. In this state, the leading end portion 313*a* of the movable contact portion 313 is received in the guide hole 121*a* in the recess 121 so as to be brought into contact with the retaining portion 121*b* of the guide hole 121*a*. When the leading end portion 313*a* is brought into contact with the retaining portion 121*b*, the elastic deformation portion 312 is elastically deformed slightly upward. The Vbus contact 310 is thus locked by the retaining portion 121*b* in the preload state, and the apex of the movable contact portion 313 projects downward from the recess 121.

Figure 4A:
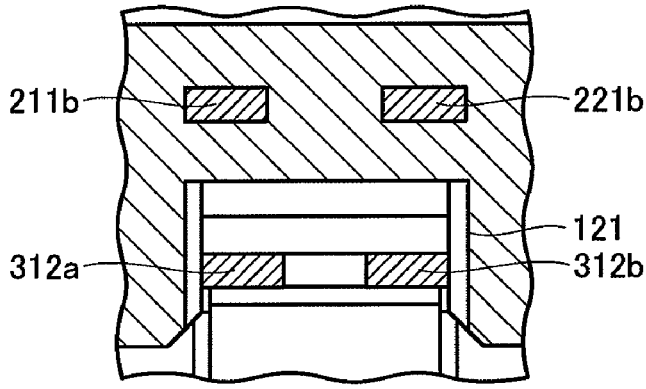
Figure 4B:
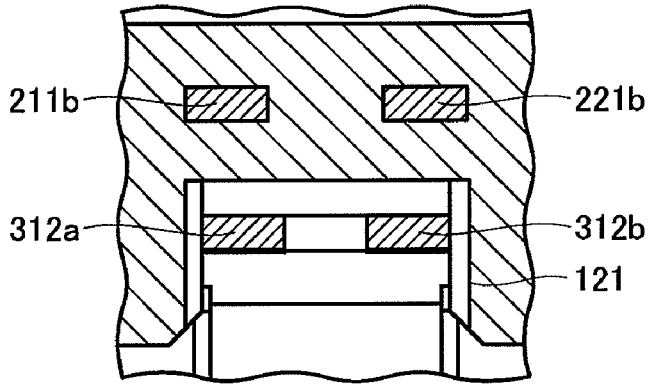
Figure 5A:
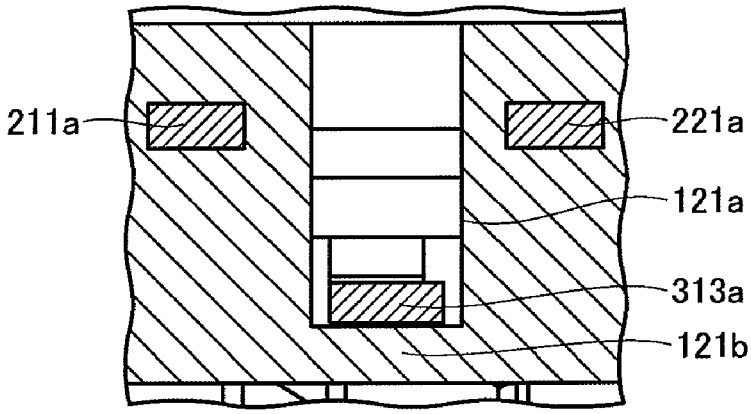
Figure 5B:
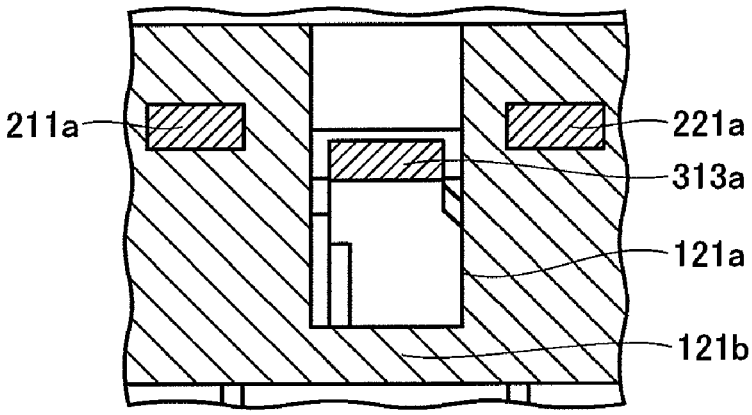
Figure 6:
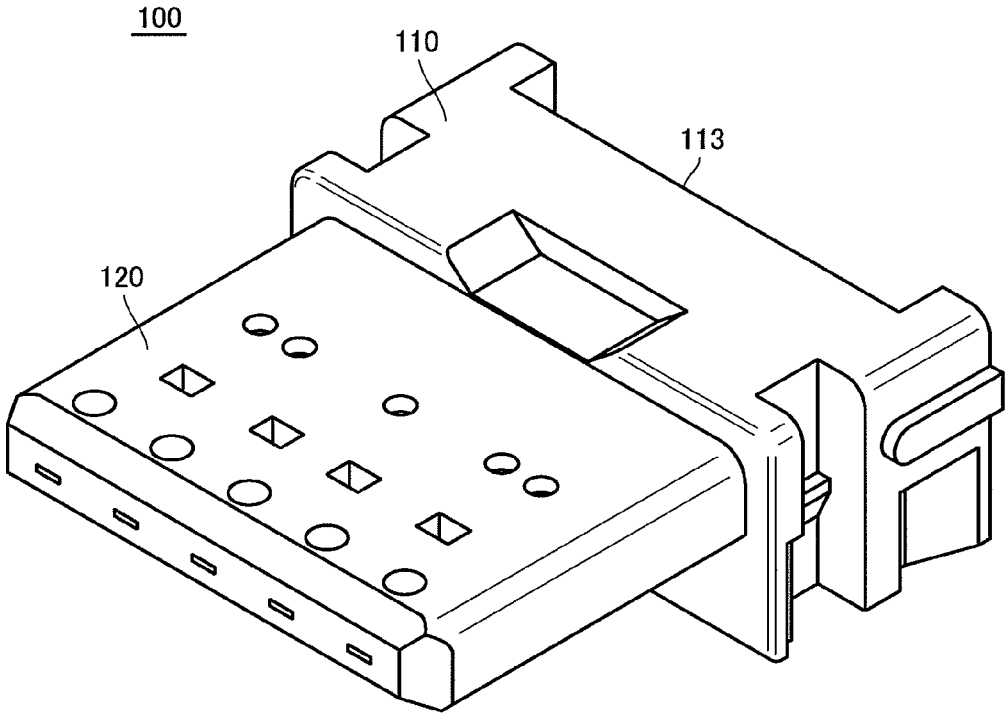
FIG. 6 is a schematic perspective view of a body of the connector.

In accordance with elastic deformation of the elastic deformation portion 312, the leading end portion 313*a* is guided by the guide hole 121*a* and displaced from a contact position as shown in FIG. 5A to an insertion position as shown in FIG. 5B. At the contact position, the leading end portion 313*a* is in contact with the retaining portion 121*b*. At the insertion position, the leading end portion 313*a* is inserted between the leading end portion 211*a* of the main portion 211 of the TX+ signaling contact 210 and the leading end portion 221*a* of the main portion 221 of the TX− signaling contact 220. The distance between the leading end portion 313*a* at the insertion position and the leading end portion 211*a* is smaller than the distance between an end portion 312*a* (to be described later) of the elastic deformation portion 312 and the rear end portion 211*b* of the main portion 211 of the TX+ signaling contact 210 as shown in FIG. 4*b*. The distance between the leading end portion 313*a* at the insertion position and the leading end portion 221*a* is smaller than the distance between an end portion 312*b* (to be described later) of the elastic deformation portion 312 and the rear end portion 221*b* of the main portion 221 of the TX− signaling contact 220 as shown in FIG. 4B. Accordingly, when the leading end portion 313*a* is displaced from the contact position to the insertion position and is inserted between the leading end portion 211*a* and the leading end portion 221*a*, the leading end portions 211*a* and 221*a* each increase in capacitance and decrease in impedance. Therefore, impedances are matched between the leading end portion 211*a* and the rear end portion 211*b* of the main portion 211 of the TX+ signaling contact 210, and between the leading end portion 221*a* and the rear end portion 221*b* of the main portion 221 of the TX− signaling contact 220. That is, the leading end portion 313*a* functions as an adjusting portion as defined in the claims.

It should be noted that the leading end portion 211*a* and the leading end portion 221*a* are at a substantially equal distance to the leading end portion 313*a* at the insertion position. Therefore, the leading end portions 211*a* and 221*a* equally increase in capacitance and decrease in impedance. Further, the pitch distance between the leading end portions 211*a* and 221*a* is larger than the pitch distance between the rear end portions 211*b* and 221*b*, preventing the leading end portions 221*a* and 211*a* from interfering with the leading end portion 313*a* at the insertion position.

In a state where the elastic deformation portion 312 is received in the front recess 111 and the recess 121 of the body 100, as shown in FIGS. 4A and 4B, 9, and 10, the widthwise end portions 312*a* and 312*b* (referred to as first and second overlapping portions in the claims) of the elastic deformation portion 312 are disposed so as to overlap in plane position with the rear end portion 211*b* of the main portion 211 of the TX− signaling contact 210 and the rear end portion 221*b* of the main portion 221 of the TX− signaling contact 220, respectively.

The area of the end portion 312*a* overlapping the rear end portion 211*b* of the TX+ signaling contact 210 and the area of the end portion 312*b* overlapping the rear end portion 221*b* of the TX− signaling contact 220 are adjusted in accordance with the difference in impedance between the TX+ signaling contact 210 and the TX− signaling contact 220. In the present embodiment, out of the end portions 312*a* and 312*b*, the end portion 312*b* closer to the TX− signaling contact 220 is extended in the width direction so as to substantially equalize the area of the end portion 312*a* overlapping the rear end portion 211*b* of the TX+ signaling contact 210 and the area of the end portion 312*b* overlapping the rear end portion 221*b* of the TX− signaling contact 220. In other words, the elastic deformation portion 312 is designed to have such a width and shape that the impedance of the TX+ signaling contact 210 is substantially equalized to the impedance of the TX− signaling contact 220. It also should be noted that the press fitting portion 311 and the lead-out portion 314 are each set to have a width in accordance with the width of the elastic deformation portion 312.

The above configuration thus corrects impedance mismatch between the TX+ signaling contact 210 and the TX− signaling contact 220 due to the offset placement of the Vbus contact 310 toward the TX+ signaling contact 210.

There is provided a long opening 312*c* (resilience suppressor) in an intermediate portion between the end portions 312*a* and 312*b* of the elastic deformation portion 312. The opening 312*c* suppresses increase in resilience of the Vbus contact 310 due to extension of the end portion 312*a* of the Vbus contact 310. As a result, the opening 312*c* can suppress increase in the contact pressure of the Vbus contact 310 to be exerted on a USB 2.0 plug contact, so that the contact pressure of the Vbus contact 310 can be set at a predetermined value that allows suitable electrical connection with a USB 2.0 plug contact.

The lead-out portion 314 is a plate-like member of a generally L shape in cross section as shown in FIGS. 1, 10, and 12. The lead-out portion 314 projects rearward from the body 100.

The connecting portion 315 is a straight plate-like member as shown in FIGS. 1, 10, and 12. The connecting portion 315 is allowed to pass through an associated through hole 521 in the base portion 520 of the spacer 500 and is electrically connectable by soldering or other means to a signal line on the circuit board 10.

As shown in FIG. 9, the GND contact 340 has a mirror image version of the Vbus contact 310, except that widthwise end portions 342*a* and 342*b* are overlapped in plane position with the RX− signaling contact 250 and the RX+ signaling contact 240. No further description is provided on the GND contact 340.

As shown in FIG. 9, the Data− contact 320 is a conductive terminal of a generally L shape in cross section. The Data− contact 320 has the press fitting portion 321, the elastic deformation portion 322 continuous from the leading end portion of the press fitting portion 321, the movable contact portion 323 continuous from the leading end portion of the elastic deformation portion 322, the lead-out portion 324 continuous from the rear end of the press fitting portion 321, and the connecting portion 325 continuous from the rear end of the lead-out portion 324.

The press fitting portion 321 is substantially the same as the press fitting portion 311 except that the press fitting portion 321 is smaller in width than the press fitting portion 311. When the press fitting portion 321 is press fitted into an associated press fitting hole 112 in the body 100, the Data− contact 320 is disposed below the ground contact 230 on the left side in FIG. 9.

Similarly to the movable contact portion 313, the movable contact portion 323 is a plate-like member of a substantially V shape in cross section. The elastic deformation portion 322 is configured the same as the elastic deformation portion 312, except that the elastic deformation portion 322 is of an equal width to the movable contact portion 323 and has no opening 312*c*. The lead-out portion 324 and the connecting portion 325 are configured substantially the same, except their widths, as the lead-out portion 314 and the connecting portion 315.

The Data+ contact 330 is the same type of contact as the Data− contact 320. When the press fitting portion 331 is press fitted into the associated press fitting hole 112 in the body 100, the Data+ contact 330 is disposed below the ground contact 230 on the right side in FIG. 9. Except that, the Data+ contact 330 is the same as the Data− contact 320, so that no further description will not be provided.

The receptacle connector configured as described above is assembled in the following steps. First, the body 100 is attached to the shell main portion 410. In this state, the cover 420 is disposed in parallel with the top panel of the shell main portion 410.

Next, the movable contact portion 313 of the Vbus contact 310 is inserted into the associated front recess 111 from the rear side of the body 100. The movable contact portion 313 is then moved toward the leading end of the body 100, and the press fitting portion 311 of the Vbus contact 310 is pressed into the press fitting hole 112 in the body 100. As a result, the elastic deformation portion 312 of the Vbus contact 310 is inserted into the front recess 111 and the recess 121 of the body 100, and the movable contact portion 313 is inserted into the recess 121 of the body 100. At this time, the leading end portion 313*a* of the movable contact portion 313 is inserted into the guide hole 121*a* in the recess 121 and is brought into contact and engaged in the preload state with the retaining portion 121*b* of the guide hole 121*a*. The Vbus contact 310 is thus attached to the body 100.

Thereafter, the Data− contact 320, the Data+ contact 330, and the GND contact 340 are attached to the body 100 similarly to the Vbus contact 310. Accordingly, the Vbus contact 310 is disposed at a plane position between the TX+ signaling contact 210 and the TX− signaling contact 220 and at a different height position from the TX+ signaling contact 210 and the TX− signaling contact 220. The Data− contact 320 and the Data+ contact 330 are disposed on opposite sides of a vertical position of the ground contact 230. The GND contact 340 is disposed at a plane position between the RX+ signaling contact 240 and the RX− signaling contact 250 and at a different height from the RX+ signaling contact 240 and the RX− signaling contact 250.

In this state, the connecting portions 214, 224, 234, 244, and 254 of the TX+ signaling contact 210, the TX− signaling contact 220, the ground contact 230, the RX+ signaling contact 240, and the RX− signaling contact 250 are inserted into the respective through holes 511 in the spacer 500. Also, the connecting portions 315, 325, 335, and 345 of the Vbus contact 310, the Data− contact 320, the Data+ contact 330, and the GND contact 340 are inserted into the respective through holes 521 in the spacer 500.

Then, the spacer 500 is inserted into the rear recess 113 of the body 100. As a result, the lead-out portions 213, 223, 233, 243, and 253 of the TX+ signaling contact 210, the TX− signaling contact 220, the ground contact 230, the RX+ signaling contact 240, and the RX− signaling contact 250 are inserted into the through holes 511 in the spacer 500, and the connecting portions 214, 224, 234, 244, and 254 project downward out of the through holes 511. Along therewith, the lower ends of the connecting portions 315, 325, 335, and 345 of the Vbus contact 310, the Data− contact 320, the Data+ contact 330, and the GND contact 340 project downward out of the through holes 521 in the spacer 500.

Thereafter, the cover 420 is bent substantially perpendicularly so as to cover the rear face of the spacer 500.

The receptacle connector assembled as described above is mounted on the circuit board 10. More specifically, the connecting portions 214, 224, 244, and 254 of the TX+ signaling contact 210, the TX− signaling contact 220, the RX+ signaling contact 240, and the RX− signaling contact 250 are connected to signal lines on the circuit board 10, and the connecting portion 234 of the ground contact 230 is connected to a ground line on the circuit board 10. Also, the connecting portions 315, 325, and 335 of the Vbus contact 310, the Data− contact 320, and the Data+ contact 330 are connected to signal lines on the circuit board 10, and the connecting portion 345 of the GND contact 340 is connected to a ground line on the circuit board 10. Furthermore, the paired connecting pieces 411 of the shell 400 are connected to a ground line on the circuit board 10.

The receptacle connector is thus mounted on the circuit board 10, and then it is connectable with a USB 3.0 plug or a USB 2.0 plug in the following manner.

When a USB 3.0 plug is inserted into the plug insertion space α, the USB 3.0 plug contacts are brought into contact with the associated contact portions 212, 222, 232, 242, and 252 of the USB 3.0 contact group 200. Along therewith, the USB 3.0 plug presses the apexes of the movable contact portions 313, 323, 333, and 343 of the USB 2.0 contact group 300, so that the movable contact portions 313, 323, 333, and 343 as well as the elastic deformation portions 312, 322, 332, and 342 are elastically deformed upward inside the front recess 111 and the recess 121 of the body 100.

At the same time, the leading end portion 313*a* of the movable contact portion 313 is guided by the guide hole 121*a* in the body 100 and displaced from the contact position as shown in FIG. 5A to the insertion position as shown in FIG. 5B. Then, the leading end portion 313*a* is inserted between the leading end portion 211*a* of the TX+ signaling contact 210 and the leading end portion 221*a* of the TX− signaling contact 220, thereby being brought closer to the leading end portion 211*a* of the TX+ signaling contact 210 and the leading end portion 221*a* of the TX− signaling contact 220. In this state, the distance between the leading end portion 313*a* and the leading end portion 211*a* becomes smaller than the distance between the end portion 312*a* of the elastic deformation portion 312 and the rear end portion 211*b* as shown in FIG. 4B, and the distance between the leading end portion 313*a* and the leading end portion 221*a* becomes smaller than the distance between the end portion 312*b* of the elastic deformation portion 312 and the rear end portion 221*b* as shown in FIG. 4B. Accordingly, the leading end portions 211*a* and 221*a* increase in capacitances and decrease in impedances. Consequently, impedances are matched between the leading end portion 211*a* and the rear end portion 211*b* and between the leading end portion 221*a* and the rear end portion 221*b*. The leading end portion 313*a* at the insertion position is at the equal distance from the leading end portion 211*a* and leading end portion 221*a*, so that the leading end portions 211*a* and 221*a* equally increase in capacitance and equally decrease in impedance.

Similarly, the leading end portion 343*a* of the movable contact portion 343 is guided by the guide hole 121*a* in the body 100 and displaced from the contact position to the insertion position. The leading end portion 343*a* is then inserted between the leading end portion 241*a* of the RX+ signaling contact 240 and the leading end portion 251*a* of the RX− signaling contact 250. In this state, the distance between the leading end portion 343*a* and the leading end portion 241*a* becomes smaller than the distance between the end portion 342*b* of the elastic deformation portion 342 and the rear end portion 241*b*. Similarly, the distance between the leading end portion 343*a* and the leading end portion 251*a* becomes smaller than the distance between the end portion 342*a* of the elastic deformation portion 342 and the rear end portion 251*b*. Accordingly, the leading end portions 241*a* and 251*a* increase in capacitance and decrease in impedance. As a result, impedances are matched between the leading end portion 241*a* and the rear end portion 241*b* as well as between the leading end portion 251*a* and the rear end portion 251*b*. The leading end portion 343*a* at the insertion position is at the equal distance from the leading end portions 241*a* and 251*a*, so that the leading end portions 241*a* and leading end portion 251*a* equally increase in capacitance and equally decrease in impedance.

At the same time, the leading end portion 323*a* of the movable contact portion 323 and the leading end portion 333*a* of the movable contact portion 333 are guided by the guide holes 121*a* in the body 100 and displaced upward. As a result, the movable contact portions 323 and 333 and the elastic deformation portions 322 and 332 become substantially in parallel with the main portion 231 of the ground contact 230.

When a USB 2.0 plug is inserted into the plug insertion space α, the apexes of the movable contact portions 313, 323, 333, and 343 of the USB 2.0 contact group 300 are brought into contact with and are pressed by the respective USB 2.0 plug contacts. Accordingly, the movable contact portions 313, 323, 333, and 343 as well as the elastic deformation portions 312, 322, 332, and 342 are elastically deformed upward inside the front recess 111 and the recess 121 of the body 100.

At this time, the leading end portion 313*a* of the movable contact portion 313 is guided by the guide hole 121*a* in the body 100 and displaced from the contact position as shown in FIG. 5A to the insertion position as shown in FIG. 5B. The leading end portion 313*a* is then inserted between the leading end portion 211*a* of the TX+ signaling contact 210 and the leading end portion 211*a* of the TX− signaling contact 220.

Similarly, the leading end portion 343*a* of the movable contact portion 343 is guided by the guide hole 121*a* in the body 100 and displaced from the contact position to the insertion position. The leading end portion 343*a* is then inserted between the leading end portion 241*a* of the RX+ signaling contact 240 and the leading end portion 251*a* of the RX− signaling contact 250.

Along with the above, the leading end portion 323*a* of the movable contact portion 323 and the leading end portion 333*a* of the movable contact portion 333 are guided by the guide holes 121*a* in the body 100 and displaced upward. As a result, the movable contact portions 323 and 333 and the elastic deformation portions 322 and 332 are brought into substantially parallel relation to the main portion 231 of the ground contact 230.

In the receptacle connector as described above, when a USB 3.0 plug is inserted into the plug insertion space α, the elastic deformation portion 312 of the Vbus contact 310 and the elastic deformation portion 342 of the GND contact 340 are elastically deformed upward. Accordingly, the leading end portion 313*a* of the movable contact portion 313 of the Vbus contact 310 and the leading end portion 343*a* of the movable contact portion 343 of the GND contact 340 are displaced from the contact positions to the insertion positions. The leading end portion 313*a* is then inserted between the leading end portion 211*a* of the TX+ signaling contact 210 and the leading end portion 221*a* of the TX− signaling contact 220, while the leading end portion 343*a* is inserted between the leading end portion 241*a* of the RX+ signaling contact 240 and the leading end portion 251*a* of the RX− signaling contact 250. At the insertion positions, the distance between the leading end portion 313*a* and the leading end portion 211*a* is smaller than the distance between the end portion 312*a* of the elastic deformation portion 312 and the rear end portion 211*b* of the main portion 211 of the TX+ signaling contact 210, and the distance between the leading end portion 313*a* and the leading end portion 221*a* is also smaller than the distance between the end portion 312*b* of the elastic deformation portion 312 and the rear end portion 221*b* of the main portion 221 of the TX− signaling contact 220. Similarly, the distance between the leading end portion 343*a* and the leading end portion 241*a* is smaller than the distance between the end portion 342*b* of the elastic deformation portion 342 and the rear end portion 241*b* of the main portion 241 of the RX+ signaling contact 240, and the distance between the leading end portion 343*a* and the leading end portion 251*a* is smaller than the distance between the end portion 342*a* of the elastic deformation portion 342 and the rear end portion 251*b* of the RX− signaling contact 250. Therefore, the leading end portions 211*a*, 221*a*, 241*a*, and 251*a* each increase in capacitance and decrease in impedance. As described above, the Vbus contact 310 of the USB 2.0 standard is advantageously used to match impedances between the leading end portion 211*a* and the rear end portion 211*b* of the main portion 211 of the TX+ signaling contact 210 and between the leading end portion 221*a* and the rear end portion 221*b* of the main portion 221 of the TX− signaling contact 220. Also, the GND contact 340 is used to match impedances between the leading end portion 241*a* and the rear end portion 241*b* of the RX+ signaling contact 240 and between the leading end portion 251*a* and the rear end portion 251*b* of the RX− signaling contact 250. As a result, impedances are matched between the TX+ signaling contact 210 and the TX− signaling contact 220 and between the RX+ signaling contact 240 and the RX− signaling contact 250.

In addition, out of the end portions 312*a* and 312*b* of the Vbus contact 310, the end portion 312*b* is extended in the width direction, so that the area of the end portion 312*a* overlapping the rear end portion 211*b* of the main portion 211 of the TX+ signaling contact 210 is substantially equalized to the area of the end portion 312*b* overlapping the rear end portion 221*b* of the main portion 221 of the TX− signaling contact 220. Similarly, out of the end portions 342*a* and 342*b* of the GND contact 340, the end portion 342*b* is extended in the width direction, so that the area of the end portion 342*b* overlapping the rear end portion 241*b* of the main portion 241 of the RX+ signaling contact 240 is substantially equalized to the area of the end portion 342*a* overlapping the rear end portion 251*b* of the main portion 251 of the RX− signaling contact 250. Therefore, even if the Vbus contact 310 is disposed offset toward the TX+ signaling contact 210 and the GND contact 340 is disposed offset toward the RX− signaling contact 250 to comply with the USB 2.0 standard, impedances can be matched between the TX+ signaling contact 210 and the TX− signaling contact 220 and between the RX+ signaling contact 240 and the RX− signaling contact 250. Also in this regard, the Vbus contact 310 and the GND contact 340 of the USB 2.0 standard are utilized to match impedances between the TX+ signaling contact 210 and the TX− signaling contact 220 and between the RX+ signaling contact 240 and the RX− signaling contact 250.

In other words, the Vbus contact 310 of the USB 2.0 standard is utilized to match impedances between the leading end portion 211*a* and the rear end portion 211*b* of the main portion 211 of the TX+ signaling contact 210 and between the leading end portion 221*a* and the rear end portion 221*b* of the main portion 221 of the TX− signaling contact 220, and also to match impedances between the TX+ signaling contact 210 and the TX− signaling contact 220. The GND contact 340 of the USB 2.0 standard is utilized to match impedances between the leading end portion 241*a* and the rear end portion 241*b* of the RX+ signaling contact 240 and between the leading end portion 251*a* and the rear end portion 251*b* of the RX− signaling contact 250, and also to match impedances between the RX+ signaling contact 240 and the RX− signaling contact 250. The connector with such a simplified configuration can be manufactured at reduced cost. Moreover, it is possible to prevent deterioration in transmission property in a pair of contacts for differential signaling, namely, the TX+ signaling contact 210 and the TX− signaling contact 220, and in another pair of contacts for differential signaling, namely, the RX+ signaling contact 240 and the RX− signaling contact 250.

Furthermore, the Vbus contact 310 is provided with the opening 312*c* in the intermediate portion between the end portion 312*a* and the end portion 312*b* of the elastic deformation portion 312, so that the opening 312*c* serves to reduce the resilience of the Vbus contact 310 that should have increased due to the extension of the end portion 312*b*. The GND contact 340 is provided with the opening 342*c* in the intermediate portion between the end portion 342*a* and the end portion 342*b* of the elastic deformation portion 342, so that the opening 342*c* serves to reduce the resilience of the GND contact 340 that should have increased due to the extension of the end portion 342*b*. As a result, it is possible to reduce the contact pressures of the Vbus contact 310 and the GND contact 340 to be exerted on the USB 2.0 plug contacts to predetermined values.

Another advantage of the above-described connector is the ease of the impedance adjustment between the TX+ signaling contact 210 and the TX− signaling contact 220. More particularly, the areas of the end portions 312*a* and 312*b* overlapping the TX+ signaling contact 210 and the TX− signaling contact 220, respectively, can be adjusted by changing the size and/or the shape of the opening 312*c*. Similarly, the impedances can be easily adjusted between the RX+ signaling contact 240 and the RX− signaling contact 250, by changing the size and/or the shape of the opening 342*c*.

The provision of the opening 312*c* in the intermediate portion reduces the areas of the end portion 312*a* and 312*b* overlapping the TX+ signaling contact 210 and the TX− signaling contact 220, respectively. Also, the provision of the opening 342*c* in the intermediate portion reduces the areas of the end portions 342*b* and 342*a* overlapping the RX+ signaling contact 240 and the RX− signaling contact 250, respectively. It is thus possible to reduce impedances of the TX+ signaling contact 210, the TX− signaling contact 220, the RX+ signaling contact 240, and the RX− signaling contact 250.

Figure 13A:
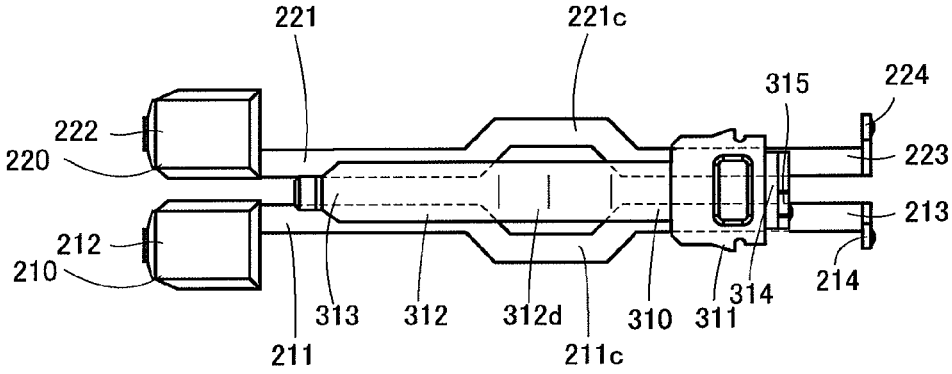
Figure 13B:
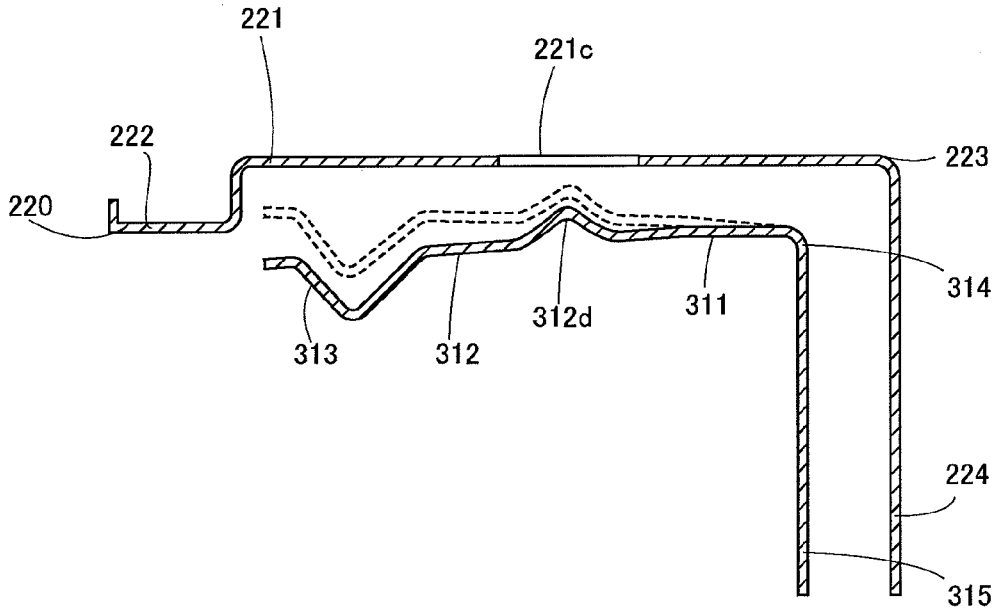
Figure 14A:
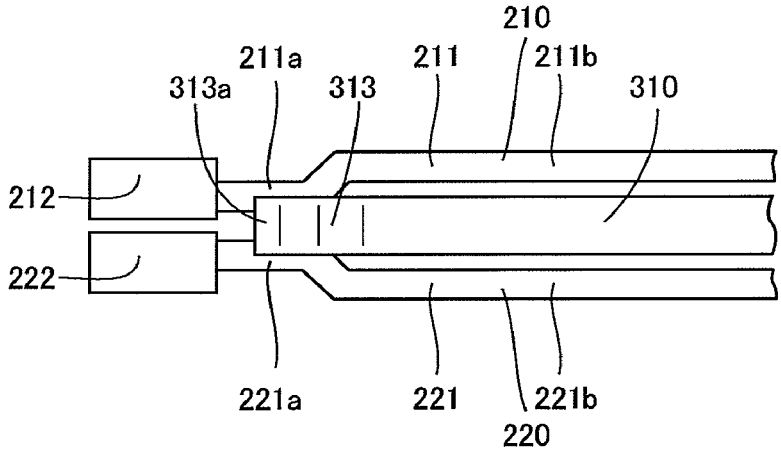
Figure 14B:
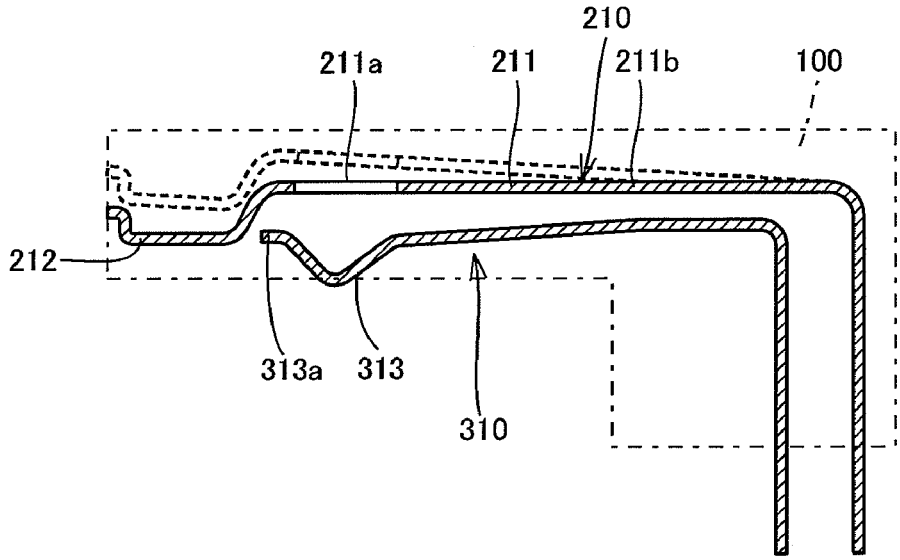
Figure 15A:
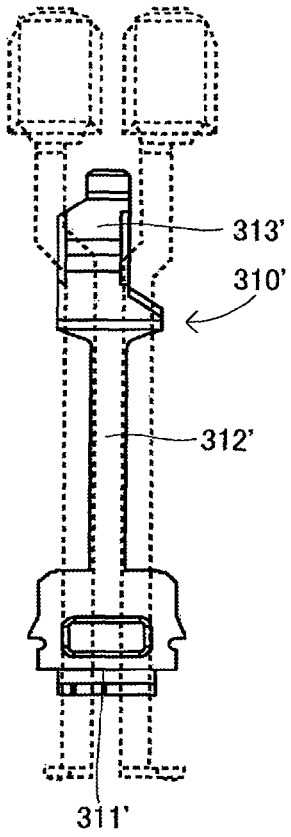
Figure 15B:
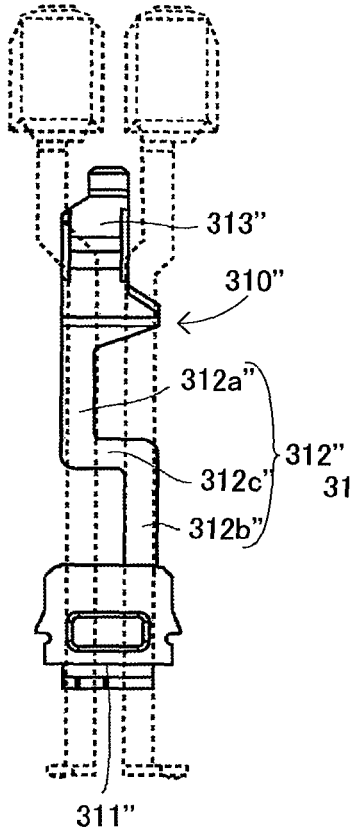
Figure 15C:
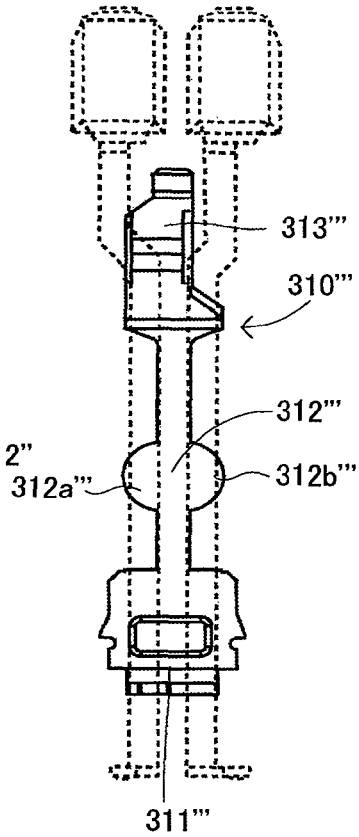

The connector described above is not limited to the above embodiment, but can be modified in design as to be described in detail below within the scope of the claims. FIGS. 13A and 13B are schematic views of a design variation of the TX+ signaling contact, the TX− signaling contact, and the Vbus contact of the connector, in which FIG. 13A is a bottom view and FIG. 13B is a cross-sectional view. FIGS. 14A and 14B are schematic views of another design variation of the TX+ signaling contact, the TX− signaling contact, and the Vbus contact of the connector, in which FIG. 14A is a bottom view and FIG. 14B is a cross-sectional view. FIGS. 15A to 15C are schematic bottom views of a design variation of the Vbus contact of the connector, in which FIG. 15A shows a configuration with no opening provided therein, FIG. 15B shows a configuration with a bent intermediate portion of an elastic deformation portion, and FIG. 15C shows a configuration with semicircular overlapping portions provided at ends of the elastic deformation portion.

The design of the body 100 can be modified in any manner as long as it can retain at least one first contact and a second contact that is disposed at a different height from that of the at least one first contact.

Further, the shapes and locations of the contacts of the USB 3.0 contact group 200 are not limited to the ones of the above embodiment but can be modified. Specifically, the USB 3.0 contact group 200 according to the above embodiment is compliant with the USB 3.0 standard, but it is not limited thereto but may be adaptable to a different standard.

The contacts of the USB 3.0 contact group 200 may be or may not be embedded in the body 100. For example, the contacts may be press-fitted into holes made in the body 100, in a similar manner as the Vbus contact 310 and other contacts that are press-fitted.

In the embodiment described above, the leading end portion 313*a* is inserted between the leading end portion 211*a* of the TX+ signaling contact 210 and the leading end portion 221*a* of the TX− signaling contact 220, and the leading end portion 343*a* is inserted between the leading end portion 241*a* of the RX+ signaling contact 240 and the leading end portion 251*a* of the RX− signaling contact 250. However, the leading end portion 313*a* has only to be brought closer to the leading end portion 211*a* of the TX+ signaling contact 210 and to the leading end portion 221*a* of the TX− signaling contact 220, and the leading end portion 343*a* has only to be brought closer to the leading end portion 241*a* of the RX+ signaling contact 240 and to the leading end portion 251*a* of the RX− signaling contact 250. Even in such a case, impedances can be matched between the leading end portion 211*a* and the rear end portion 211*b* of the main portion 211 of the TX+ signaling contact 210, between the leading end portion 221*a* and the rear end portion 221*b* of the main portion 221 of the TX− signaling contact 220, between the leading end portion 241*a* and the rear end portion 241*b* of the RX+ signaling contact 240, and between the leading end portion 251*a* and the rear end portion 251*b* of the RX− signaling contact 250. For the convenience of description, a detailed description is made below only on the relation of the leading end portion 313*a* with the leading end portion 211*a* of the TX+ signaling contact 210 and the leading end portion 221*a* of the TX− signaling contact 220, without referring to the relation of the leading end portion 343*a* with the leading end portion 241*a* of the RX+ signaling contact 240 and the leading end portion 251*a* of the RX− signaling contact 250. This is because the description on the former relation can be applied to the latter relation.

In the above embodiment, at the insertion positions, the distance between the leading end portion 313*a* and the leading end portion 211*a* is smaller than the distance between the end portion 312*a* of the elastic deformation portion 312 and the rear end portion 211*b* of the TX+ signaling contact 210, and the distance between the leading end portion 313*a* and the leading end portion 221*a* is smaller than the distance between the end portion 312*b* of the elastic deformation portion 312 and the rear end portion 221*b* of the TX− signaling contact 220. However, the present invention is not limited to these distance relations. The distance relations depend on the pitch distance between the leading end portion 211*a* and the leading end portion 221*a* and the shapes thereof. Accordingly, with the leading end portion 313*a* being brought close to the leading end portion 211*a* of the TX+ signaling contact 210 and to the leading end portion 221*a* of the TX− signaling contact 220, the distance between the leading end portion 313*a* and the leading end portion 211*a* may be substantially equal to or larger than the distance between the end portion 312*a* of the elastic deformation portion 312 and the rear end portion 211*b* of the TX+ signaling contact 210, and the distance between the leading end portion 313*a* and the leading end portion 221*a* may be substantially equal to or larger than the distance between the end portion 312*b* of the elastic deformation portion 312 and the rear end portion 221*b* of the TX− signaling contact 220. Even in such a case, impedances can be matched between the leading end portion 211*a* and the rear end portion 211*b* of the main portion 211 of the TX+ signaling contact 210 and between the leading end portion 221*a* and the rear end portion 221*b* of the main portion 221 of the TX− signaling contact 220, because the leading end portion 313*a* is brought closer to the leading end portion 211*a* of the TX+ signaling contact 210 and to the leading end portion 221*a* of the TX− signaling contact 220.

In the above embodiment, the leading end portion 313*a* at the insertion position is equally distanced from the leading end portion 211*a* and the leading end portion 221*a*. However, the present invention is not limited thereto. For example, in a case where the leading end portion 211*a* and the leading end portion 221*a* have different shapes, such as with different widths, the distance between the leading end portion 313*a* and the leading end portion 211*a* is not required to be substantially equal to the distance between the leading end portion 313*a* and the leading end portion 221*a* at the insertion position. Moreover, as described above, the same is true in a case where the leading end portion 313*a* is only brought closer to the leading end portion 211*a* and the leading end portion 221*a*.

In the embodiment described above, the leading end portion 211*a* of the main portion 211 and the leading end portion 221*a* of the main portion 221 act as the mismatched portions with different impedances from the rear end portion 211*b* of the main portion 211 and the rear end portion 221*b* of the main portion 221, respectively. However, the present invention is not limited thereto. For example, in a case as shown in FIG. 13A where a wide pitch distance is provided between an intermediate portion 211*c* of the main portion 211 and an intermediate portion 221*c* of the main portion 221, the intermediate portion 211*c* and the intermediate portion 221*c* serve as the mismatched portions, and other portions of the main portion 211 and the main portion 221 may be each defined as "another portion." In this case, the intermediate portion of the elastic deformation portion 312 of the Vbus contact 310 may be provided with a bent portion 312*d*, which can be brought close to the intermediate portions 211*c* and 221*c* in accordance with elastic deformation of the elastic deformation portion 312, as shown in FIG. 13B. In other words, the bent portion 312*d* functions as the adjusting portion. Moreover, the "another portion" defined in the claims is not limited to the portion other than the mismatched portion of the main portion, but is to be appropriately determined in relation to the mismatched portion.

According to the above embodiment, the leading ends 211*a* and 221*a* act as the mismatched portions due to the larger pitch distance between the leading end portion 211*a* and the leading end portion 221*a* than the pitch distance between the rear end portion 211*b* and the rear end portion 221*b*. However, the present invention is not limited to the above case. Alternatively, the leading end portions 211*a* and 221*a* may act as the mismatched portions due to a difference in shape, such as width or thickness, of the leading end portions 211*a* and 221*a* from the rear end portions 211*b* and 221*b*. This modification is also applicable to the above case where portions other than the leading end portions 211*a* and 221*a* act as the mismatched portions.

Further, the leading end portions 211*a* and 221*a* may act as the mismatched portions due to a smaller pitch distance between the leading end portion 211*a* and the leading end portion 221*a* than the pitch distance between the rear end portion 211*b* and the rear end portion 221*b*. In other words, the leading end portions 211*a* and 221*a* may be lower in impedance than the rear end portions 211*b* and 221*b*. In this case, as shown in FIGS. 14A and 14B, the TX+ signaling contact 210 and the TX− signaling contact 220 can elastically deform in a direction away from the Vbus contact 310, and the leading end portion 211*a* of the main portion 211 of the TX+ signaling contact 210 and the leading end portion 221*a* of the main portion 221 of the TX− signaling contact 220 are displaced in a direction away from the leading end portion 313*a* of the Vbus contact 310. Such displacements reduce the capacitances and increase the impedances of the leading end portions 211*a* and 221*a*. Even in this case, the Vbus contact 310 of the USB 2.0 standard can be used to match impedances between the leading end portion 211*a* and the rear end portion 211*b* of the main portion 211 of the TX+ signaling contact 210 and between the leading end portion 221*a* and the rear end portion 221*b* of the main portion 221 of the TX− signaling contact 220. Alternatively, in stead of the TX+ signaling contact 210 and the TX− signaling contact 220, the Vbus contact 310 may elastically deform in a direction away from the TX+ signaling contact 210 and the TX− signaling contact 220, and the leading end portion 313*a* of the Vbus contact 310 may be displaced in a direction away from the leading end portion 211*a* of the main portion 211 of the TX+ signaling contact 210 and from the leading end portion 221*a* of the main portion 221 of the TX− signaling contact 220. This modification is similarly applicable to the above case where portions other than the leading end portions 211*a* and 221*a* act as the mismatched portion.

In the embodiment described above, the Vbus contact 310, the Data− contact 320, the Data+ contact 330, and the GND contact 340 are provided as movable terminals that are elastically deformable, and the TX+ signaling contact 210, the TX− signaling contact 220, the ground contact 230, the RX+ signaling contact 240, and the RX− signaling contact 250 are provided as fixed terminals that are embedded in the body 100. Alternatively, the Vbus contact 310, the Data− contact 320, the Data+ contact 330, and the GND contact 340 may be provided as fixed terminals and the TX+ signaling contact 210, the TX− signaling contact 220, the ground contact 230, the RX+ signaling contact 240, and the RX− signaling contact 250 may be provided as movable terminals. In such a case, the TX+ signaling contact 210, the TX− signaling contact 220, the RX+ signaling contact 240, and the RX− signaling contact 250 may be elastically deformed by an inserted plug, so that the leading end portion 313*a* is brought relatively close to the leading end portion 211*a* of the TX+ signaling contact 210 and the leading end portion 221*a* of the TX− signaling contact 220, and the leading end portion 343*a* is brought relatively close to the leading end portion 241*a* of the RX+ signaling contact 240 and the leading end portion 251*a* of the RX− signaling contact 250.

In the above embodiment, the TX+ signaling contact 210 and the TX− signaling contact 220 are a pair of differential signaling contacts and the RX+ signaling contact 240 and the RX− signaling contact 250 are another pair of differential signaling contacts. Alternatively, these contacts may be provided as other kind of contacts than the differential signaling contacts. In other words, the present invention is applicable to a case where there is a difference in impedance between a portion (mismatched portion) and another portion of a single contact (first contact) due to the relation with adjacent contacts, the shapes thereof, or other reasons. More specifically, a portion of the second contact disposed at a different height from the first contact is brought relatively close to or apart from the mismatched portion by elastic deformation of the first or second contact, so that impedances can be matched between the mismatched portion of the first contact and the another portion.

The shapes and arrangement of the contacts of the USB 2.0 contact group 300 are not limited to the ones of the above embodiment but may be modified in design. In other words, the USB 2.0 contact group 300 is not limited to contacts compliant with the USB 2.0 standard, but may be applicable to contacts of a different standard.

The above embodiment is described such that the area of the end portion 312*a* of the Vbus contact 310 overlapping the rear end portion 211*b* of the main portion 211 of the TX+ signaling contact 210 is substantially equal to the area of the end portion 312*b* of the Vbus contact 310 overlapping the rear end portion 221*b* of the main portion 221 of the TX− signaling contact 220, and such that the area of the end portion 342*b* of the GND contact 340 overlapping the rear end portion 241*b* of the main portion 241 of the RX+ signaling contact 240 is substantially equal to the area of the end portion 342*a* of the GND contact 340 overlapping the rear end portion 251*b* of the main portion 251 of the RX− signaling contact 250. However, in a case where the Vbus contact 310 is not disposed offset toward the TX+ signaling contact 210 and the GND contact 340 is not disposed offset toward the RX− signaling contact 250 (i.e. in a case where the Vbus contact 310 is located at midpoint between the TX+ signaling contact 210 and the TX− signaling contact 220 and the GND contact 340 is located at midpoint between the RX+ signaling contact 240 and the RX− signaling contact 250), the end portions 312*a* and 312*b* of the Vbus contact 310 are not required to overlap the TX+ signaling contact 210 and the TX− signaling contact 220, respectively, in plane position, and the end portions 342*b* and 342*a* of the GND contact 340 are not required to overlap the RX+ signaling contact 240 and the RX− signaling contact 250, respectively, in plane position.

In the case where the Vbus contact 310 and the GND contact 340 are disposed offset as in the above embodiment, the area of the end portion 312*a* overlapping the rear end portion 211*b* of the TX+ signaling contact 210 and the area of the end portion 312*b* overlapping the rear end portion 221*b* of the TX− signaling contact 220 are not required to be made substantially equal to each other as described above but may be adjusted in accordance with the difference in impedance between the TX+ signaling contact 210 and the TX− signaling contact 220.

In the above embodiment, the end portions 312*a* and 312*b* of the elastic deformation portion 312 overlap the rear end portion 211*b* of the main portion 211 of the TX+ signaling contact 210 and the rear end portion 221*b* of the main portion 221 of the TX− signaling contact 220, respectively, in plane position, and the end portions 342*b* and 342*a* of the elastic deformation portion 342 overlap the rear end portion 241*b* of the main portion 241 of the RX+ signaling contact 240 and the rear end portion 251*b* of the main portion 251 of the RX− signaling contact 250, respectively, in plane position. Alternatively, other portions of the Vbus contact 310 and the GND contact 340 may be overlapped in plane position.

An example of such modification is a Vbus contact 310' as shown in FIG. 15A. Without extending one of two ends of an elastic deformation portion 312', the area of one end (first overlapping portion) overlapping a first differential signaling contact is made substantially equal to the area of the other end (second overlapping portion) overlapping a second differential signaling contact. FIG. 15A also illustrates a press fitting portion 311' and a movable contact portion 313' of the modified Vbus contact 310'.

Another example is a Vbus contact 310" as shown in FIG. 15B, wherein a connecting portion 312*c*" is provided to connect a leading end portion 312*a*" (first overlapping portion) of the elastic deformation portion 312" and a proximal end portion 312*b*" (second overlapping portion) of the elastic deformation portion 312". The connecting portion 312*c*" extends perpendicular to the leading end portion 312*a*" and to the proximal end 312*b*". Also in this case, the area of the leading end portion 312*a*" overlapping the first differential signaling contact may be made substantially equal to the area of the proximal end 312*b*" overlapping the second differential signaling contact, so that the first and second differential signaling contacts are matched in impedance. The connecting portion 312*c*" may extend at an angle to the leading end portion 312*a*" and the proximal end 312*b*". FIG. 15B also illustrates a press fitting portion 311" and a movable contact portion 313" of the modified Vbus contact 310".

Still another modification example is a Vbus contact 310''' as shown in FIG. 15C, wherein the elastic deformation portion 312''' has semicircular overlapping portions 312*a*''' and 312*b*''' in its intermediate portion. The areas of the overlapping portions 312*a*''' and 312*b*''' overlapping the first and second differential signaling contacts are set to be substantially equal to each other, so that the first and second differential signaling contacts are matched in impedance. FIG. 15C also illustrates a press fitting portion 311''' and a movable contact portion 313''' of the modified Vbus contact 310'''.

In the embodiment described above, the Vbus contact 310 and the GND contact 340 are provided in the intermediate portions of the elastic deformation portions 312 and 342 with the openings 312*c* and 342*c* that function as the resilience suppressors. However, these resilience suppressors are optional. Furthermore, the resilience suppressors are not limited to such openings but may be modified in design as long as the resilience suppressors are capable of suppressing the resiliences of the second contacts such as the Vbus contact 310 and the GND contact 340, which resiliences should have increased due to the widthwise extension for the purpose of impedance matching. The resilience suppressors may be formed as cutouts provided at the opposite ends of the proximal ends of the elastic deformation portions 312 and 342, or may be formed as thin portions provided at the elastic deformation portions 312 and 342, or may be formed in any other manners.

The connector described above is compliant with the two types of standards, namely, USB 2.0 and USB 3.0 standards. However, the connector of the invention is not limited to this but may be adaptable to different standards. Further, the above connector is described as a receptacle connector, but the connector is applicable to a plug connector having contacts connected to a cable.

REFERENCE SIGNS LIST

100 body
210 TX+ signaling contact (first contact)
211*a* leading end portion (mismatched portion)
211*b* rear end portion (another portion)
220 TX− signaling contact (first contact)
221*a* leading end portion (mismatched portion)
221*b* rear end portion (another portion)
240 RX+ signaling contact (first contact)
241*a* leading end portion (mismatched portion)
241*b* rear end portion (another portion)
250 RX− signaling contact (first contact)
251*a* leading end portion (mismatched portion)
251*b* rear end portion (another portion)
310 Vbus contact (second contact)
312 elastic deformation portion
312*a* end portion (second overlapping portion)
312*b* end portion (first overlapping portion)
312*c* opening (resilience suppressor)
313 movable contact portion
313*a* leading end portion (adjusting portion)
340 GND contact (second contact)

342 elastic deformation portion
342*a* end portion (second overlapping portion)
342*b* end portion (first overlapping portion)
342*c* opening (resilience suppressor)
343 movable contact portion
343*a* leading end portion
400 shell

The invention claimed is:

1. A connector comprising:
an insulative body;
a pair of first contacts disposed in the body; and
a second contact disposed in the body, at a different height level from the first contacts and between the first contacts in plane position, wherein
the first contacts or the second contact is elastically deformable,
the first contacts each include a mismatched portion and another portion, the mismatched portion having a higher impedance than that of the another portion,
the second contact includes an impedance adjusting portion and another portion, the impedance adjusting portion being capable of decreasing the impedances of the mismatched portions when brought close to the mismatched portions by elastic deformation of the first contacts or the second contact in a direction to bring the second contact and the first contacts closer, and
in a state where the first contacts or the second contact is elastically deformed, a distance between each of the mismatched portions and the impedance adjusting portion is smaller than a distance between each of the another portions of the first contacts and another portion of the second contact.

2. The connector according to claim 1, wherein
the first contacts are contacts for differential signaling.

3. The connector according to claim 1, wherein
the impedance adjusting portion comprises a leading end portion of the second contact.

4. The connector according to claim 1, wherein
the body is provided with a guide hole for receiving leading end portions of the first contacts or a leading end portion of the second contact so as to be movable in a direction along elastic deformation of the first contacts or the second contact.

5. The connector according to claim 4, wherein
the impedance adjusting portion comprises the leading end portion of the second contact.

6. The connector according to claim 1, wherein
a pitch distance between the mismatched portions of the paired first contacts is larger than a pitch distance between the another portions of the paired first contacts,
in the state where the first contacts or the second contact is elastically deformed in the direction close to the second contact or the first contacts, the impedance adjusting portion is inserted between the mismatched portions of the paired first contacts so as to be located at an equal distance from either of the mismatched portions, and
the body is provided with a retaining portion for allowing leading end portions of the first contacts or a leading end portion of the second contact to be in contact therewith in a preloaded state so as to prevent the first contacts or the second contact from elastically deforming in a direction away from the second contact or the first contacts.

7. The connector according to claim 6, wherein
the impedance adjusting portion comprises the leading end portion of the second contact.

8. The connector according to claim 6, wherein
the body is provided with a guide hole for receiving the leading end portions of the first contacts or the leading end portion of the second contact so as to be movable in a direction along elastic deformation of the first contacts or the second contact.

9. The connector according to claim 8, wherein
the impedance adjusting portion comprises the leading end portion of the second contact.

10. The connector according to claim 6, wherein
the second contact is disposed offset toward one of the paired first contacts,
the second contact has a first overlapping portion overlapping one of the first contacts in plane position and a second overlapping portion overlapping the other first contact in plane position, and
areas of the first and second overlapping portions overlapping the first contacts are adjusted in accordance with a difference in impedance between the first contacts.

11. The connector according to claim 10, wherein
the areas of the first and second overlapping portions overlapping the first contacts are substantially equal to each other.

12. The connector according to claim 11, wherein
the first and second overlapping portions comprise widthwise opposite ends of the second contact, and at least one of the first and second overlapping portions is extended in the width direction.

13. The connector according to claim 12, wherein
the second contact is an elastically deformable terminal, and
the second contact is provided with a resilience suppressor for suppressing increase in resilience of the second contact due to the extension in the width direction of the at least one of the first and second overlapping portions.

14. The connector according to claim 13, wherein
the resilience suppressor comprises an opening made in an intermediate portion between the first and second overlapping portions of the second contact.

15. The connector according to claim 11, wherein
the second contact further comprises a connecting portion for connecting the first overlapping portion on a leading side and the second overlapping portion on a proximal side, and the connecting portion extends perpendicularly or at an angle to the first and second overlapping portions.

16. The connector according to claim 1, wherein
a pitch distance between the mismatched portions of the paired first contacts is larger than a pitch distance between the another portions of the paired first contacts,
in the state where the first contacts or the second contact is elastically deformed in the direction close to the second contact or the first contacts, the impedance adjusting portion is inserted between the mismatched portions of the paired first contacts so as to be located at an equal distance from either of the mismatched portions.

17. The connector according to claim 1, wherein
the second contact is disposed offset toward one of the paired first contacts,
the second contact has a first overlapping portion overlapping one of the first contacts in plane position and a second overlapping portion overlapping the other first contact in plane position, and
areas of the first and second overlapping portions overlapping the first contacts are adjusted in accordance with a difference in impedance between the first contacts.

18. The connector according to claim 17, wherein the areas of the first and second overlapping portions overlapping the first contacts are substantially equal to each other.

19. The connector according to claim 18, wherein the second contact further comprises a connecting portion for connecting the first overlapping portion on a leading side and the second overlapping portion on a proximal side, and the connecting portion extends perpendicularly or at an angle to the first and second overlapping portions.

20. The connector according to claim 18, wherein the first and second overlapping portions comprise widthwise opposite ends of the second contact, and at least one of the first and second overlapping portions is extended in the width direction.

21. The connector according to claim 20, wherein the second contact is an elastically deformable terminal, and the second contact is provided with a resilience suppressor for suppressing increase in resilience of the second contact due to the extension in the width direction of the at least one of the first and second overlapping portions.

22. The connector according to claim 21, wherein the resilience suppressor comprises an opening made in an intermediate portion between the first and second overlapping portions of the second contact.

23. A connector comprising:

an insulative body;

a pair of first contacts disposed in the body; and a second contact disposed in the body, at a different height level from the first contacts and between the first contacts in plane position, wherein the first contacts or the second contact is elastically deformable, the first contacts each include an mismatched portion and another portion, the mismatched portion having a higher impedance than that of the another portion, the second contact includes an impedance adjusting portion and another portion, the impedance adjusting portion being configured to be brought close to the mismatched portions by elastic deformation of the first contacts or the second contact in a direction to bring the second contact and the first contacts closer, and the body is provided with a guide hole for receiving leading end portions of the first contacts or a leading end portion of the second contact so as to be movable in a direction along elastic deformation of the first contacts or the second contact.

24. The connector according to claim 23, wherein the impedance adjusting portion comprises the leading end portion of the second contact.

25. A connector comprising:

an insulative body;

a pair of first contacts disposed in the body; and a second contact disposed in the body, at a different height level from the first contacts and between the first contacts in plane position, wherein the first contacts or the second contact is elastically deformable, the first contacts each include a mismatched portion and another portion, the mismatched portion having a higher impedance than that of the another portion, the second contact includes an impedance adjusting portion and another portion, the impedance adjusting portion being configured to be brought close to the mismatched portions by elastic deformation of the first contacts or the second contact in a direction to bring the second contact and the first contacts closer, and the impedance adjusting portion comprises a leading end portion of the second contact.

26. A connector comprising:

an insulative body;

a pair of first contacts disposed in the body; and a second contact disposed in the body, at a different height level from the first contacts and between the first contacts in plane position, wherein the first contacts or the second contact is elastically deformable, the first contacts each include an mismatched portion and another portion, the mismatched portion having a higher impedance than that of the another portion, the second contact includes an impedance adjusting portion and another portion, the impedance adjusting portion being configured to be brought close to the mismatched portions by elastic deformation of the first contacts or the second contact in a direction to bring the second contact and the first contacts closer, the second contact is disposed offset toward one of the paired first contacts, the second contact has a first overlapping portion overlapping one of the first contacts in plane position and a second overlapping portion overlapping the other first contact in plane position, and areas of the first and second overlapping portions overlapping the first contacts are adjusted in accordance with a difference in impedance between the first contacts.

27. The connector according to claim 26, wherein the areas of the first and second overlapping portions overlapping the first contacts are substantially equal to each other.

28. The connector according to claim 27, wherein the second contact further comprises a connecting portion for connecting the first overlapping portion on a leading side and the second overlapping portion on a proximal side, and the connecting portion extends perpendicularly or at an angle to the first and second overlapping portions.

29. The connector according to claim 27, wherein the first and second overlapping portions comprise widthwise opposite ends of the second contact, and at least one of the first and second overlapping portions is extended in the width direction.

30. The connector according to claim 29, wherein the second contact is an elastically deformable terminal, and the second contact is provided with a resilience suppressor for suppressing increase in resilience of the second contact due to the extension in the width direction of the at least one of the first and second overlapping portions.

31. The connector according to claim 30, wherein the resilience suppressor comprises an opening made in an intermediate portion between the first and second overlapping portions of the second contact.

32. A connector comprising:

an insulative body; and a first contact and a second contact that are disposed in the body at different height levels from each other, the first contact or the second contact being elastically deformable, wherein the first contact includes a mismatched portion and another portion, the mismatched portion having a lower impedance than that of the another portion, and the second contact includes an impedance adjusting portion spaced apart from the mismatched portion, the impedance adjusting portion being capable of increasing the impedance of the mismatched portion when spaced further apart from the mismatched portion by elastic deformation of the first contact or the second contact in a direction to space the second contact and the first contact apart.

33. The connector according to claim 32, wherein the first contact comprises a pair of first contacts.

* * * * *